US007237469B2

(12) United States Patent
Murello

(10) Patent No.: US 7,237,469 B2
(45) Date of Patent: Jul. 3, 2007

(54) FIREARMS HAVING A LOCKED BREECH

(75) Inventor: Johannes Murello, Deiblingen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 271 days.

(21) Appl. No.: 11/072,174

(22) Filed: Mar. 4, 2005

(65) Prior Publication Data

US 2005/0217473 A1 Oct. 6, 2005

Related U.S. Application Data

(63) Continuation of application No. PCT/EP2003/009483, filed on Aug. 27, 2003, and a continuation-in-part of application No. 10/956,562, filed on Oct. 1, 2004, now abandoned, which is a continuation of application No. PCT/EP03/09490, filed on Aug. 27, 2003.

(30) Foreign Application Priority Data

Sep. 4, 2002 (DE) ..... 102 40 889
Sep. 4, 2002 (DE) ..... 102 40 891

(51) Int. Cl.
*F41A 3/46* (2006.01)

(52) U.S. Cl. ..... 89/191.01; 89/187.01

(58) Field of Classification Search ..... 89/191.01, 89/193, 187.01
See application file for complete search history.

(56) References Cited

U.S. PATENT DOCUMENTS 2,031,305 A 2/1936 End et al. ..... 89/184

(Continued)

FOREIGN PATENT DOCUMENTS

AT 393 028 B 7/1991

(Continued)

OTHER PUBLICATIONS

English language translation of International Preliminary Examination Report for patent application serial No. PCT/EP2003/009483, Mar. 25, 2004.

(Continued)

*Primary Examiner*—Stephen M. Johnson
(74) *Attorney, Agent, or Firm*—Hanley, Flight & Zimmerman, LLC

(57) ABSTRACT

Firearms having a locked breech are disclosed. An example firearm includes a barrel; a bolt head; a firing pin having a bulge; a bolt head carrier having a forward position and a rearward position; a central force receiving component receiving a rear end of the barrel and defining a plurality of recesses; and a locking bolt penetrating the bolt head. The locking bolt is movable between: (1) a locked position wherein the locking bolt engages in the recesses of the central force receiving component to thereby lock the bolt head to the central force receiving component and (2) an unlocked position wherein the bolt head is free to move with the bolt head carrier. The locking bolt is pressed by the bolt head carrier into the locked position when the bolt head carrier is in the distal position. The locking bolt defines an oblong hole which is penetrated by the firing pin. The oblong hole has a beveled edge which engages the bulge of the firing pin to push the firing pin rearward when the locking bolt moves from the locked position to the unlocked position. The barrel defines a gas intake opening. A gas cylinder is located in the central force receiving component. The gas cylinder is in communication with the gas intake opening. The bolt head carrier forms at least a portion of a gas piston which cooperates with the gas cylinder.

11 Claims, 14 Drawing Sheets

U.S. PATENT DOCUMENTS

| | | | | |
|---|---|---|---|---|
| 2,267,501 | A | 12/1941 | Holek | 89/185 |
| 2,732,768 | A | 1/1956 | Browning | 42/16 |
| 3,213,558 | A | 10/1965 | Horsrud | 42/17 |
| 3,791,060 | A | 2/1974 | Weaver | 42/16 |
| 3,906,651 | A | 9/1975 | Vasemaa | 42/25 |
| 4,580,484 | A | 4/1986 | Moore | 89/128 |
| 4,604,942 | A | 8/1986 | Benelli | 89/185 |
| 4,635,530 | A * | 1/1987 | Weldle | 89/159 |
| 5,834,678 | A * | 11/1998 | Kalb | 89/187.01 |
| 5,983,774 | A | 11/1999 | Mihaita | 89/188 |

FOREIGN PATENT DOCUMENTS

| | | |
|---|---|---|
| DE | 374753 | 4/1923 |
| FR | 637.155 | 4/1928 |
| FR | 1.266.597 | 6/1961 |
| GB | 465112 | 4/1937 |
| GB | 649519 | 1/1951 |

OTHER PUBLICATIONS

International Search Report for patent publication No. WO 2004/029534, Mar. 25, 2004.

English language translations of the annexes to the International Preliminary Examintation Report for patent application serial No. PCT/EP03/009483.

U.S. Appl. No. 10/956,562, filed Oct. 1, 2004, Johannes Murello, Locked Automatic and Semi-Automatic Firearms, Abandoned.

U.S. Appl. No. 11/072,765, filed Mar. 4, 2005, Johannes Murello, Cartridge Ejection Mechanisms and Methods for Operating the Same, Abandoned.

U.S. Appl. No. 11/072,155, filed Mar. 4, 2005, Johannes Murello, Firearms With Gas Pressure Loading Mechanisms, Pending.

U.S. Appl. No. 11/072,761, filed Mar. 4, 2005, Johannes Murello, Firearms and Methods of Operating the Same, Pending.

* cited by examiner

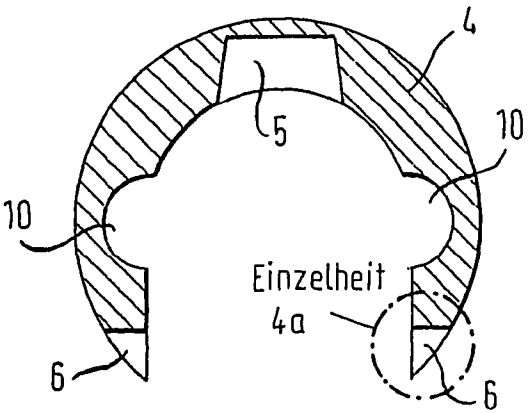
Fig. 4
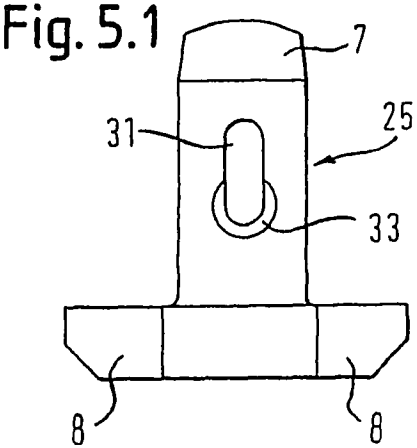
Fig. 5.1
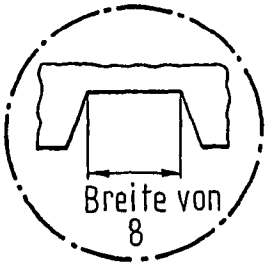
Fig. 4a
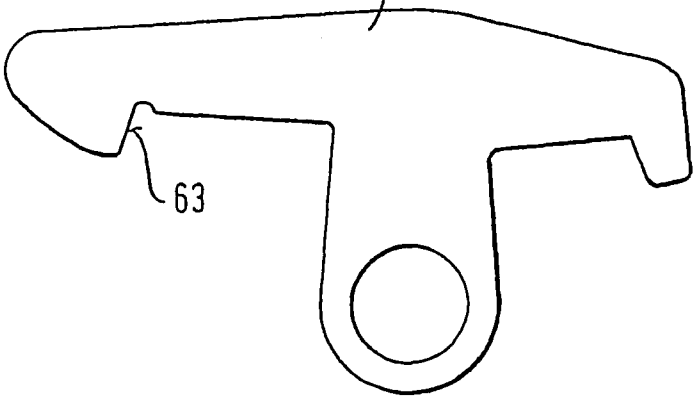
Fig. 7
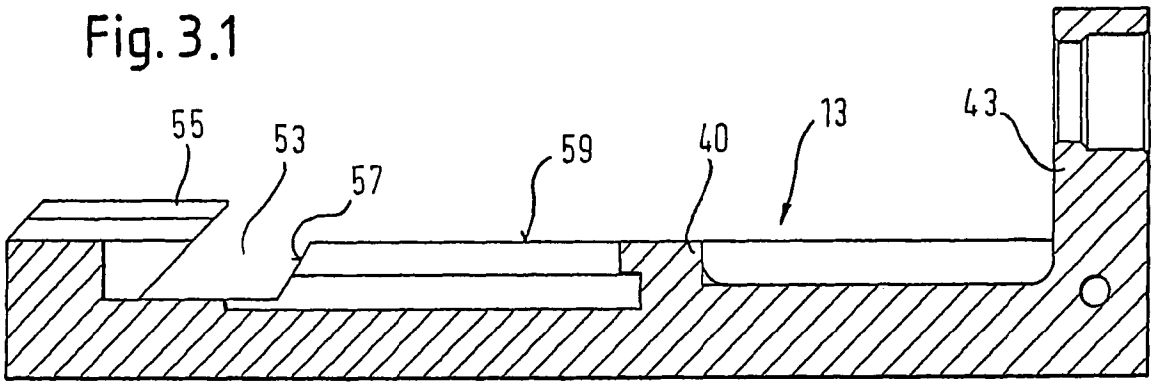
Fig. 3.1

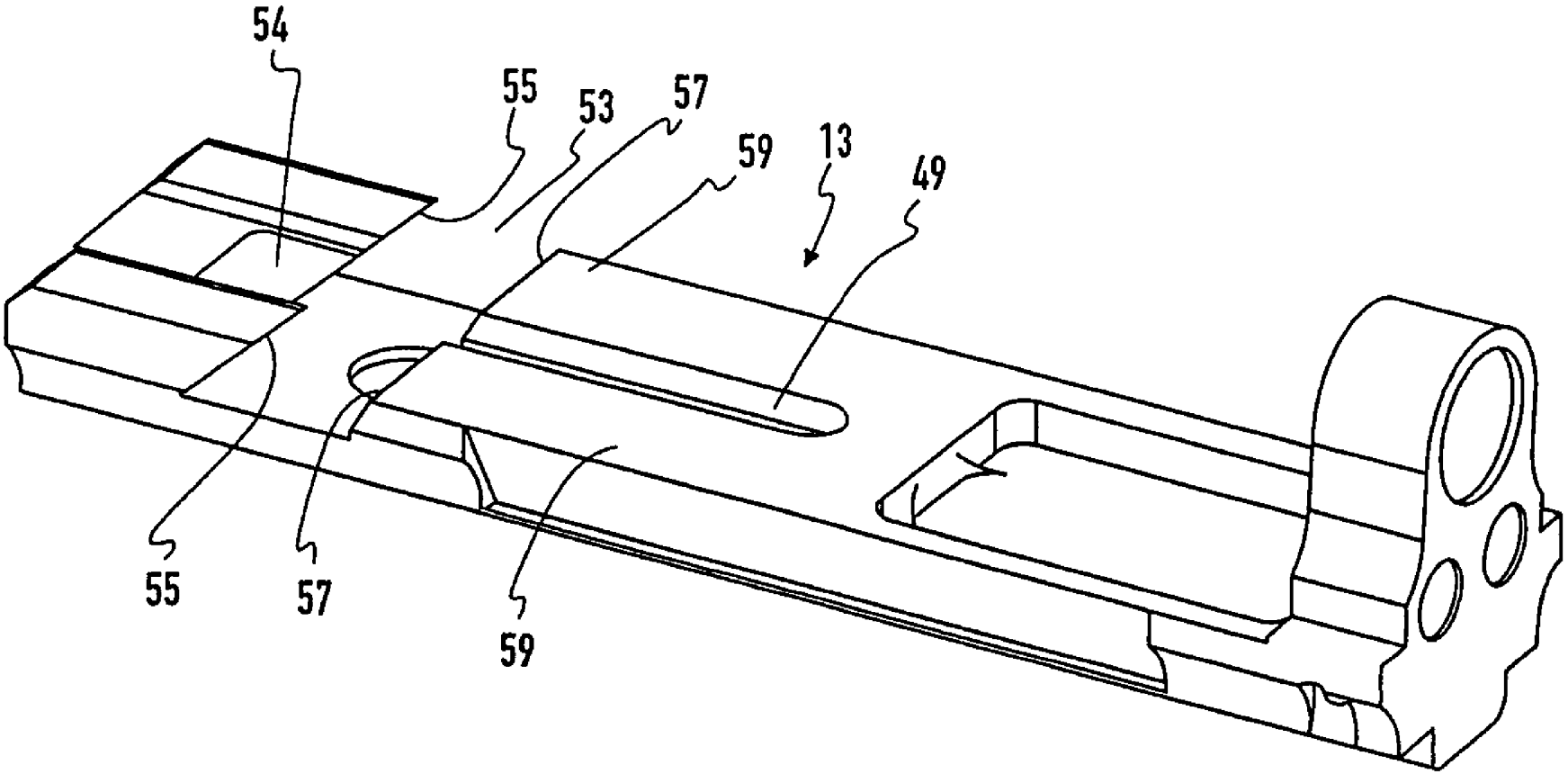
Fig. 3.2

Fig. 5.2
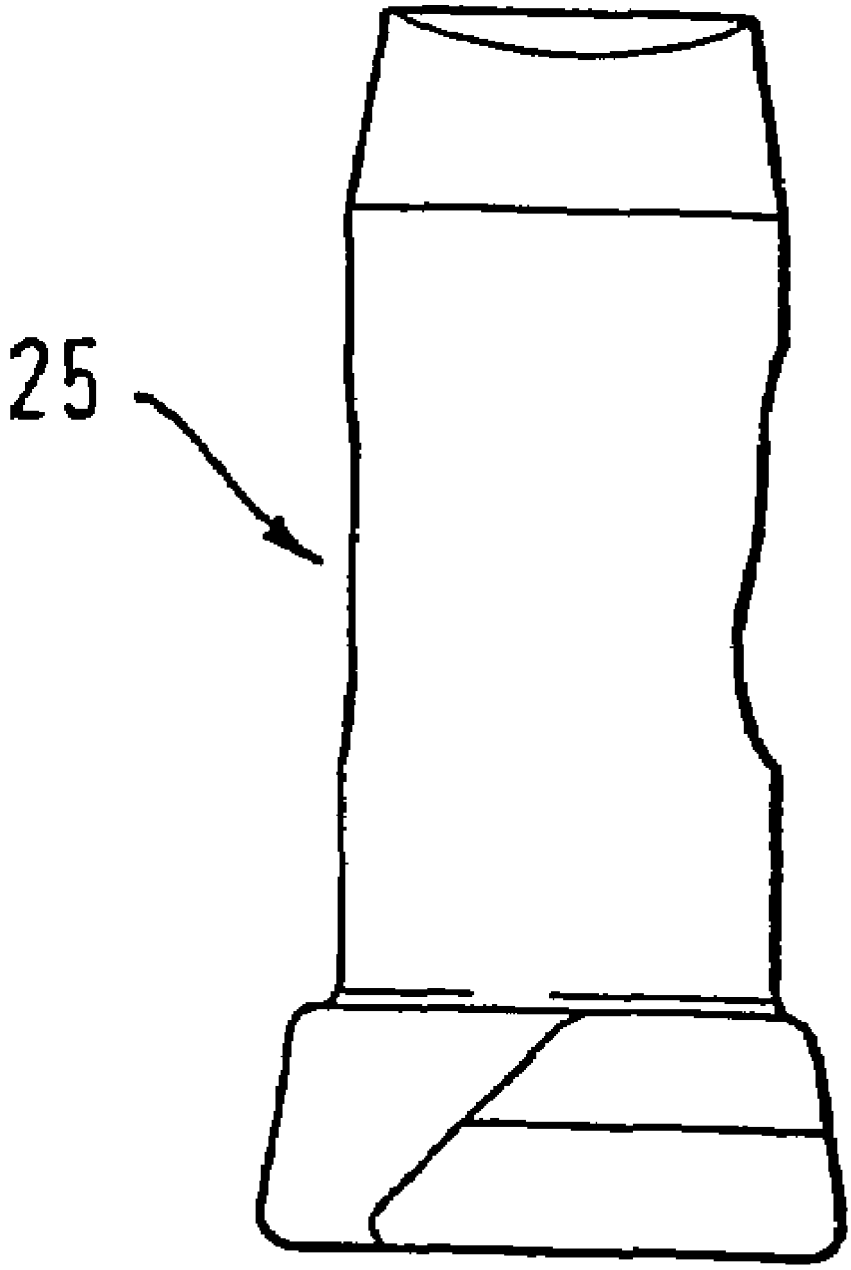

Fig. 12.2
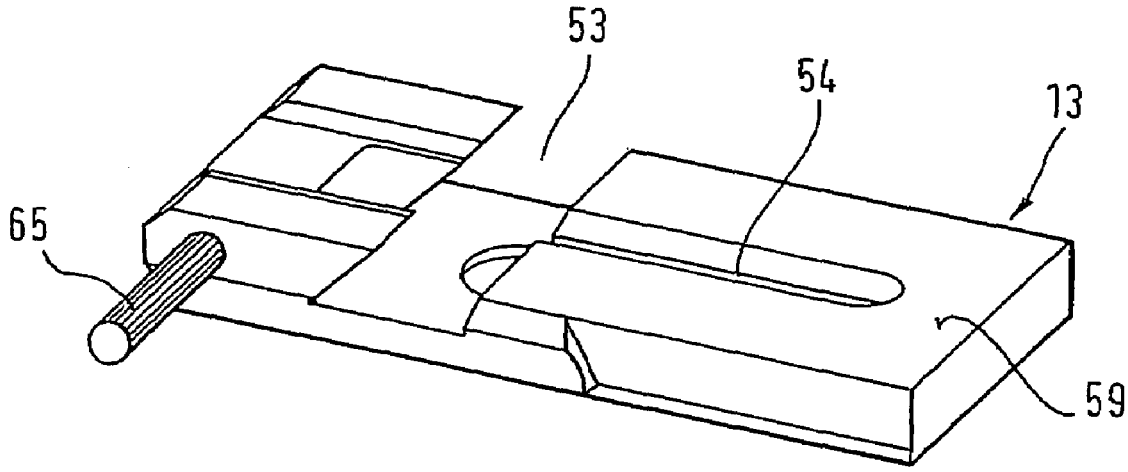
Fig. 12.1
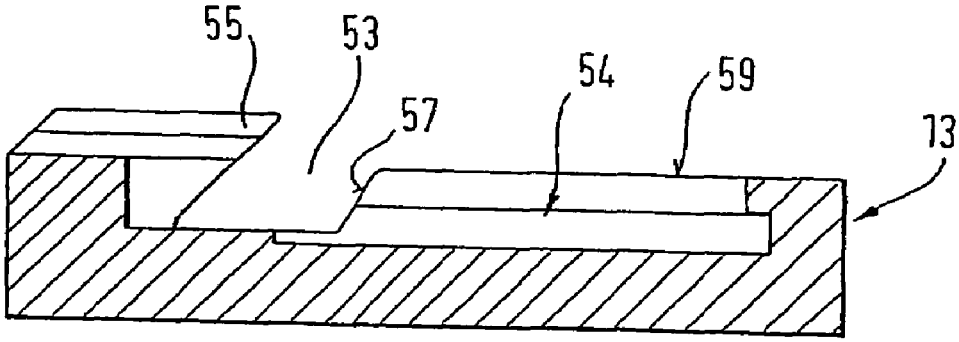

FIREARMS HAVING A LOCKED BREECH

RELATED APPLICATION

This patent arises from a U.S. patent application which is (a) a continuation of International Patent Application Serial No. PCT/EP2003/009483, filed Aug. 27, 2003, and (b) a continuation-in-part of U.S. patent application Ser. No. 10/956,562, filed on Oct. 1, 2004 now abandoned. U.S. patent application Ser. No. 10/956,562 is a continuation of International Patent Application Serial Number PCT/EP03/09490, which was filed on Aug. 27, 2003. International Patent Application Serial No. PCT/EP2003/009483, International Patent Application Serial Number PCT/EP03/09490, and U.S. patent application Ser. No. 10/956,562 are all hereby incorporated herein by reference in the entirety.

FIELD OF THE DISCLOSURE

This disclosure relates generally to handheld firearms, and more particularly, to firearms having a locked breech and locked breeches for firearms.

BACKGROUND

Throughout this patent, position designations such as "above," "below," "top" "forward," "rear," etc. are referenced to a firearm held in a normal firing position (i.e., pointed away from the shooter in a generally horizontal direction).

Semi-automatic firearms with sensitive cartridge cases, in particular semi-automatic shot guns, have always been problematic. In particular, problems arise due to the extremely low resistance of the cartridges to residual pressure when loading the weapon. With semi-automatic shot guns, it is an additional problem in that cartridges with exactly the same measurements can have very different payloads, which in turn makes for different residual pressures.

Additionally, the breech on many semi-automatic weapons tends to open when the bullet is still in the barrel and/or when the gas pressure has not fallen sufficiently.

With a semi-automatic weapon, like a shot gun or a semi-automatic pistol designed for strong cartridges and/or a long-barreled pistol, low residual pressure will cause most cartridge shells to inflate or burst when the lock is opened. Such residual pressure is unavoidable in a simple semi-automatic pistol with a blow-back breech. But locked recoil operated guns also have residual pressure when the breech opens which some shotgun cartridge shells cannot sustain. Recoil-loading semi-automatic rifles, which are made for weak cartridges, have jamming problems when used with stronger ammunition. These jamming problems can be attributed to the increased residual pressure associated with stronger ammunition.

Some shot-gun cartridge shells have, in the past, been made entirely of metal. However, due to the high price and weight associated with such a construction, such metal shells were not generally accepted.

An additional problem is the low tensile-load capacity of a shot-gun cartridge shell in its longitudinal direction. With cheap shot-gun cartridge shells made of cardboard with metal bottoms, such loads may cause the metal bottom in the cartridge chamber to separate from the remainder of the shell. The low conicity of shot-gun cartridges contributes to this tendency.

For approximately 100 years, shot guns have used a recoil-loading system in which, upon the firing of a shot, the barrel and the closed breech first recoil back over the full recoil range. The pressure is almost completely dissipated in this run-back process. (Browning, Walther type weapons utilize this sort of recoil loading system.) In such systems, after the breech reaches the rearmost position, it remains fixed and the barrel is decelerated under the power of a spring such that the barrel is returned relatively slowly towards the front. The breech and the cartridge shell remain stationary as the barrel returns to the forward position, so that the cartridge is gently extracted from the barrel. Thus, excessive longitudinal forces do not act upon the cartridge shell. After the ejection of the cartridge shell, the breech snaps forward again under the effect of the closing spring. In the process, the breech carries a new cartridge forward into the cartridge chamber.

Such a shot gun is very reliable—even with differently charged ammunition. But, it has two different disadvantages. First, a built-in brake is provided to slow the movement of the barrel and perform an adjustment for extreme cartridge charge differences (i.e., for different sized cartridges). However, this brake only works under strictly defined conditions (for example, only when the components are lightly oiled). Second, the relatively slow, powerful backwards movement of the barrel requires support from the housing. This support takes place in that the weapon is pressed into the shoulder of the shooter. However, if the weapon is shot from the hip, then this support is not provided, which can lead to serious loading malfunctions. Such a system is, therefore, not suitable for shot guns that are used in military and/or police applications.

Recently, the tendency has been to switch to gas pressure loaders for shot guns. Gas pressure loaders have long been used in semi-automatic rifles and have proven themselves in that context. But, semi-automatic shot guns require a defined gas pressure and an easily removable, rugged shot cartridge shell. With modern, powerful cartridges that have a cartridge floor made of metal with a long sleeve and a shell body made of longitudinally ribbed plastic, such gas pressure loader shot guns enjoy trouble-free operation. Moreover, even with poor quality cartridges, gas pressure loader firearms do not have the support disadvantage of recoil-loading shot guns. Thus, the gas pressure loader functions the same when the weapon is fired from the hip and when the weapon is fired from the shoulder.

However, gas pressure loaders are very complicated. Depending on the powder used, they require different levels of cleaning and are susceptible to dirt, rust, and lack of oil due to the many metal-on-metal contact areas. Cutting down on gas pistons by loading the breech with drawn-off powder gases leads to structural simplification, but increases the risk of fouling.

Modern recoil loaders are also known that operate without movement of the barrel (e.g., the G3 weapon). However, this functionality is achieved at a cost in sensitivity with respect to ammunition. In other words, such recoil loading weapons, in particular these types of shot guns, are very sensitive as far as ammunition is concerned.

Another recoil-loading system that is locked, but still has a rigid barrel, is also known for shot guns. This system, which is described in U.S. Pat. No. 4,604,942, has a bolt head carrier seated loosely in the weapon. The bolt head carrier remains in position due to its mass inertia while all other parts of the weapon run backwards due to the recoil. The bolt head carrier and the bolt head are constructed such that they eventually strike each other. This seemingly simple weapon is, in fact, very complicated. Moreover, the recoil loading system does not seem to function safely, as a weapon that came to market with this system is no longer offered for sale.

This system was later combined with a pump gun mechanism in the Benelli Super M 3. In that combination, the semi-automatic activity could be optionally disabled. These known weapons have a tube magazine, which is not practical for a service weapon.

Soon after the emergence of the repeating firearms with cylinder breech mechanisms, attempts were made to simplify the loading motion. To load by hand, the marksman had to make a transverse motion, a back motion, a forward motion and again a transverse motion. Consequently, a kind of worm gear was developed, which converts a simple back and forward motion into the above specified complicated movement. Due to the complicated mechanics, these so-called straight pull action systems either did not prove themselves or were too expensive. In the case of these known straight pull action systems, a breech block is assigned to the actual breech or bolt head, which could be viewed as a bolt head carrier.

There are also other systems for simplifying the loading motion. Such a system was realized prior to the above named straight pull action system. In that earlier system, the breech can be moved in a straight line forward until reaching the cartridge base in the cartridge chamber. When the breech reaches this position, a cross slide or locking block is moved into recesses in the breech and into the case of the weapon to thereby lock the breech. A bottom lever is rotated downward in an arc-shaped motion in an initial run to release the locking block. The unlocked breech is then pulled back in an end run. The breech is not closed and locked until the bottom lever is rotated upward. A box magazine has also been known for use with this system since 1895.

Similar systems are not activated by a bottom lever, but rather by a slide which is joined to the fore end and can be moved in a straight line. However, in these systems, the locking block executes a rotating motion.

All of the above described systems are quite complicated and correspondingly expensive and sensitive.

In the case of locking blocks with bottom levers and fore end loaders, particularly in the case of those that use heavy cartridges, high surface pressures occur. These pressures can only be counteracted by awkwardly shaped constructions or extremely high precision.

Particularly in the case of weapons for emergency use, ruggedness, small dimensions, and reliability should be combined with a low price. Such weapons are typically only used in rare emergencies, but then they must function safely under difficult circumstances.

U.S. Pat. No. 3,906,651 appears to illustrate a cartridge with a round profile seated on the breech block of a breech that has two opposing extractor hooks.

BRIEF DESCRIPTION OF THE DRAWINGS

FIG. 3.1 is a longitudinal cross-sectional view through the bolt head carrier of FIGS. 1 and 2, but shown in a slightly larger scale than that used in FIGS. 1 and 2.

FIG. 3.2 is a top perspective view of the example bolt head carrier shown in FIG. 3.1.

FIG. 4 is a cross-sectional view through the rear part (end section) of the barrel piece of FIG. 1, shown along the center axis of a locking recess.

FIG. 4*a* is an enlarged view of the detail 4*a* of FIG. 4, shown transversely to the longitudinal direction of the weapon.

FIG. 5.1 is a rear view of the example locking block.

FIG. 5.2 is a side view of the locking block of FIG. 5.1.

FIG. 7 is a greatly enlarged view of an example extractor claw.

FIG. 12.1 is a longitudinal cross-sectional view through the bolt head carrier of FIGS. 10 and 11, but shown in a slightly larger scale than that used in FIGS. 10 and 11.

FIG. 12.2 is a top perspective view of the example bolt head carrier shown in FIG. 12.1.

DETAILED DESCRIPTION

Figure 2:
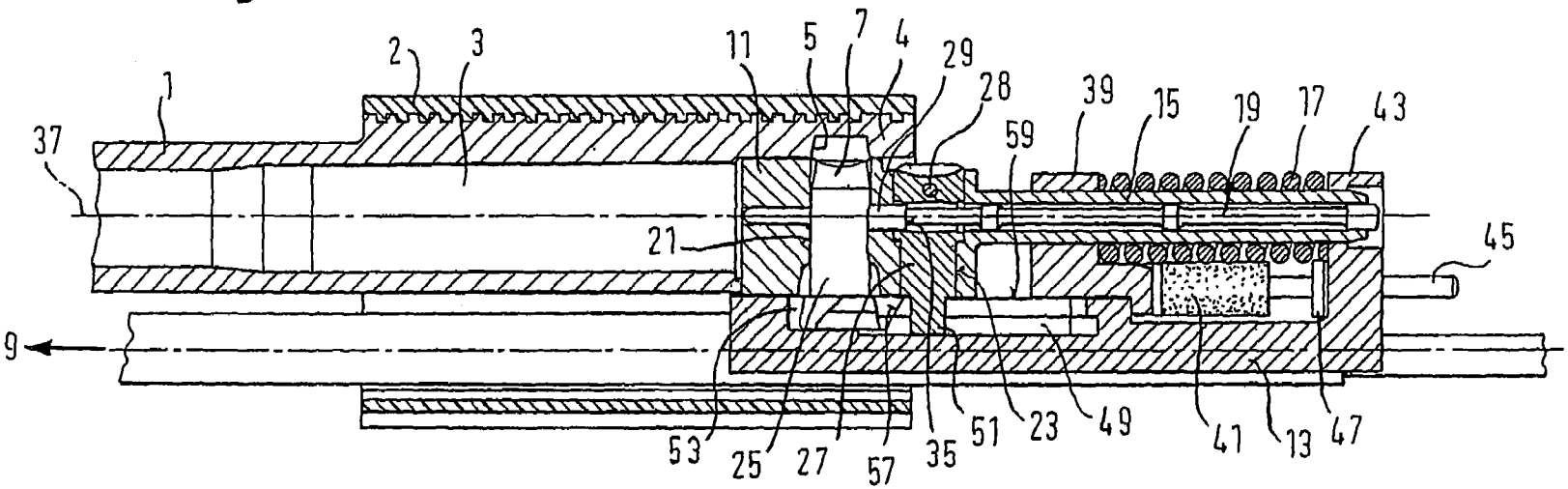
FIG. 2 is a cross-sectional view of the example weapon of FIG. 1, but showing the weapon with an unlocked breech immediately after the firing of a shot.
Figure 1:
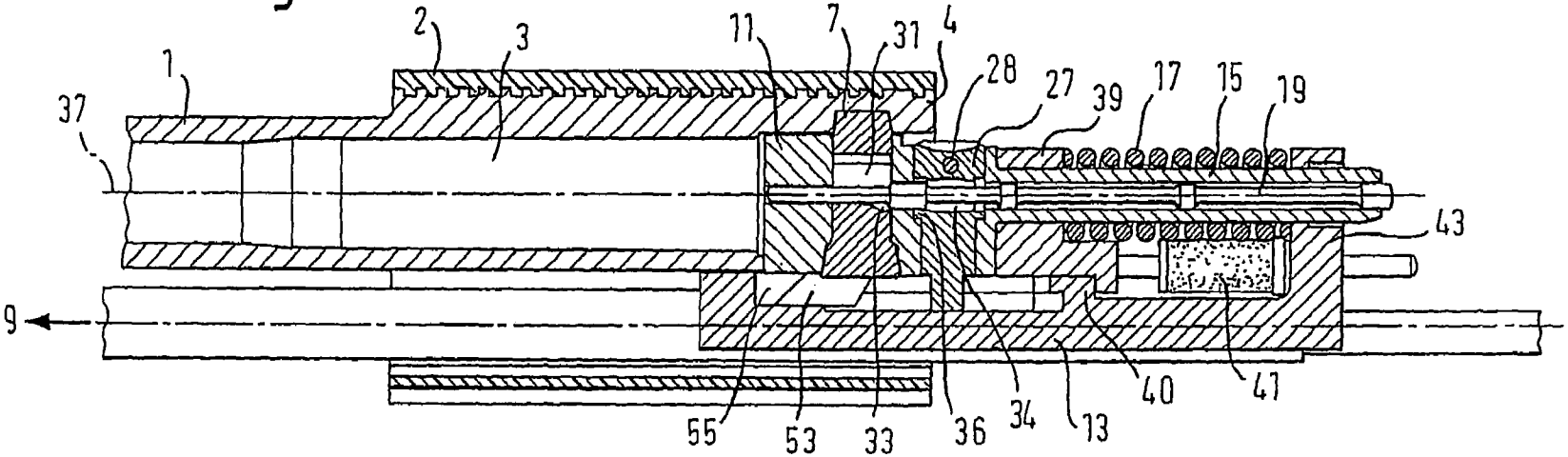
FIG. 1 is a longitudinal cross-sectional view through the rear part of the barrel piece and the breech of an example shot gun shown with a closed and locked breech.

The example weapon shown in FIGS. 1 and 2 is a semi-automatic shot gun that can be provided with a case magazine. The shot gun of FIG. 1 has a barrel piece (1) with a center or bore axis (37). A cartridge chamber (3) is located in the rear part of this barrel piece (1). An end section (4) of the barrel piece (1) defines the cartridge chamber (3).

The end section (4) has an almost U-shaped cross-section. As shown in FIG. 4, the U-shaped cross-section of the end section (4) is open on the bottom, has a concentric, upper locking recess (5), and two locking notches (6) on the bottom. The locking notches (6) are located in the free ends of the two legs of the U-shaped cross-section. A groove (10) is provided at approximately half the height of each leg of the U-shaped cross-section. Each groove (10) runs parallel to the bore axis (37). A cartridge extractor (61) such as that shown in FIG. 7, can run in each of these grooves (10).

When the weapon is cocked and ready to fire as shown in FIG. 1, the cartridge chamber 3) is locked toward the back by a bolt head (11). The bolt head (11) is penetrated by a front, vertical, transverse drill hole that receives a locking block (25). As shown in FIG. 5.1, the locking block (25) has an upside-down T-shaped cross-section which is oriented perpendicularly relative to the bore axis (37). The locking block (25) has a conical locking appendage (7) on the free (upper) end of its center shaft. As also shown in FIG. 5.1, the locking block (25) includes a locking finger (8) on each of the two ends of the (lower) transverse shaft. In the locked position, the locking appendage (7) engages with the locking recess (5) and the locking fingers (8) simultaneously engage with their corresponding locking notches (6).

In the example shown in the figures, all of the engagement surfaces are sloped with respect to a vertical line in order to facilitate effortless engagement and detachment of the locking block (25) in the end section (4) of the barrel piece (1). However, in the illustrated example, the sloped angles of the surfaces are so low that the engagement is self-locking, (i.e., the engagement cannot be released by applying a force on the bolt head (11) along the bore axis (37) towards the back of the weapon).

As a result of the engagement of the locking block (25) and the rear section (4) of the barrel piece (1), the barrel piece (1) and the bolt head (11) are directly connected with each other during a shot. Therefore, the barrel piece (1) and the bolt head (11) transfer high initial forces directly to each other. No other element is affected by this transfer of force. The back end of the barrel piece (1) can, therefore, be embedded into a plastic housing (2) because the largest occurring forces are not discharged into the housing (2).

In the illustrated example, the bolt head (11) sits on a bolt head carrier (13), which is shown in detail in FIGS. 3.1 and 3.2. The bolt head carrier (13) can be moved a certain distance longitudinally relative to the bolt head (11). The bolt head carrier (13) has a longitudinal recess (54), a transverse recess (53) in the area below the locking block (25), and level surface (59) behind this recess (53).

The transverse recess (53) is bordered on each side of the longitudinal recess (54) by a nose (55) (see FIG. 3.2). Each nose (55) flanges upward and backward as shown in FIG. 3.1. Each flange terminates at a height above the level surface (59).

The locking block (25) is constructed such that, in its upper locking position, the lower surface of its transverse shaft is rounded off almost flush with the lower surface of the bolt head (11) (FIG. 1). In this position, the bolt head carrier (13) can move forward and backward under the locking block (25) and the bolt head (11), and the locking block (25) can glide on the level surfaces (59) of the bolt head carrier (13).

However, if the bolt head carrier (13) moves backwards from the resting position shown in FIG. 1, then both noses (55) engage the transverse shaft of the locking block (25) with their rear edges. As a result, the noses (55) pull the locking block (25) down into the transverse recess (53) into the position shown in FIG. 2. In this position, the lock block (25) disengages from the end section (4) of the barrel piece (1). As a result of this disengagement, the bolt head (11) is free to move backward relative to the barrel piece (1).

During further backward movement, the unlocked bolt head (11) runs in a guide (not shown) in the housing (2). During this rearward movement, the locking block (25) is held such that it cannot move upward.

When closing, the bolt head (11) hits the rear end of the cartridge chamber (3). The bolt head carrier (13) is then pulled or pushed further forward by a closing spring (9) (shown schematically in FIGS. 1 and 2 as the direction of force (9)). In this process, one taper (57) forming the back wall of the transverse recess (53) cams the locking block (25) in the upward direction until the level surface (59) reaches under the locking block (25) and the position of FIG. 1 is reached once again.

Figure 6:
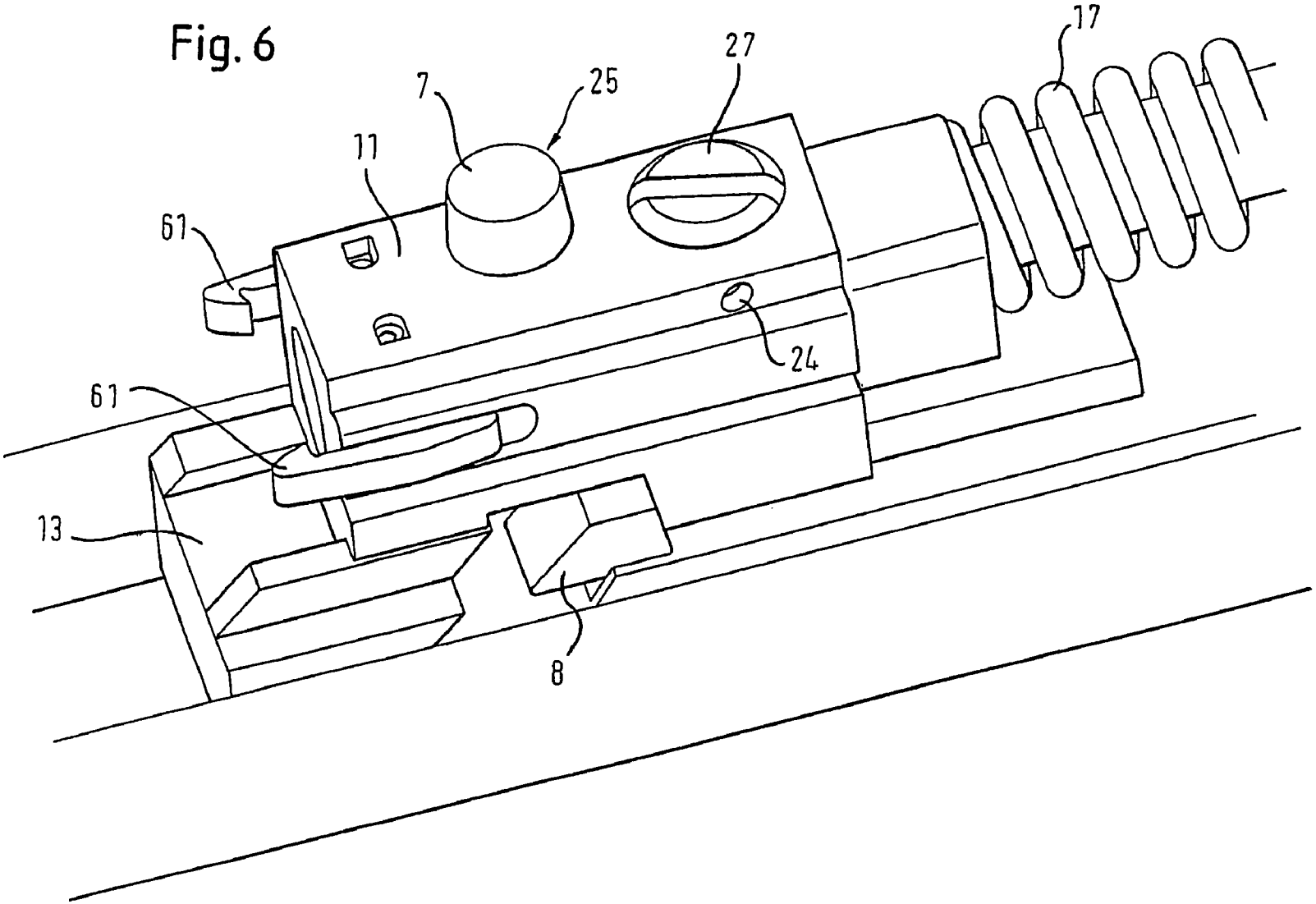
FIG. 6 is a top perspective view of the breech shown approximately in the state shown in FIG. 1.
Figure 9:
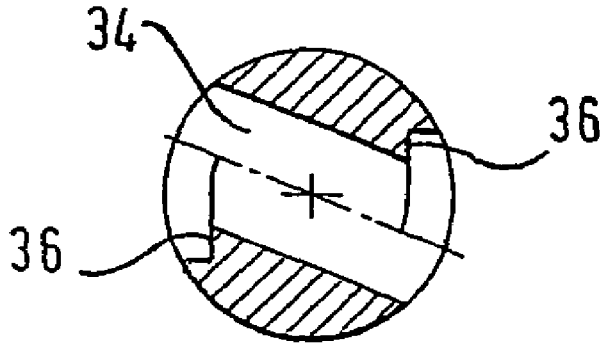
FIG. 9 is a cross-sectional view of the stripping block, taken along line IX-IX of FIG. 8.
Figure 8:
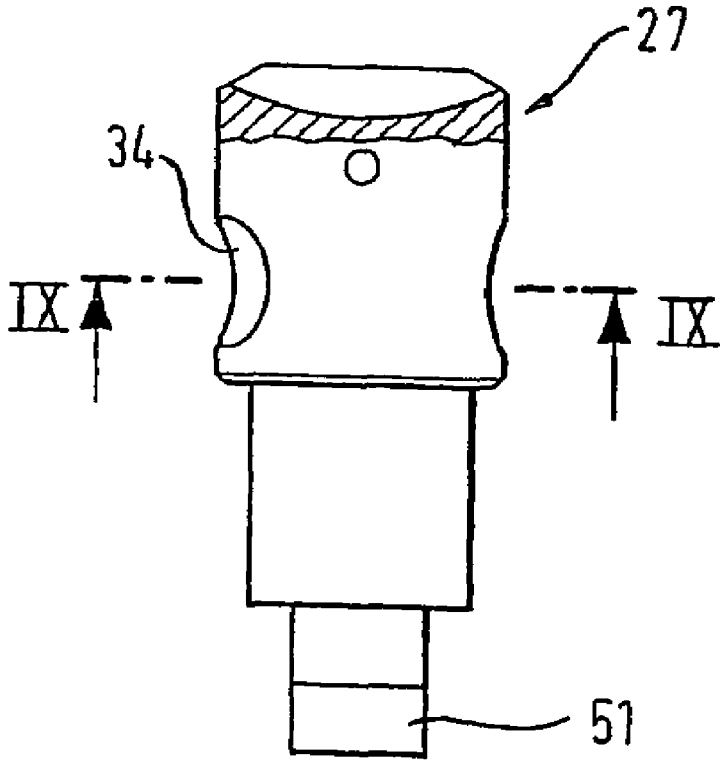
FIG. 8 is a side view of the stripping block.

A pivotable stripping block (27) is located in the bolt head (11) behind the locking block (25). The stripping block (27) is held in its position of use by a pin (28) (see FIGS. 1, 2, 6, 8, and 9). The stripping block (27) is located in a rear, vertical transverse bore (23) in the bolt head (11). The pin (28) can be disengaged via the bore hole (24) in the bolt head (11) as shown in FIG. 6.

The locking block (25) and the stripping block (27) are penetrated by a striker or firing pin (19). Each of the locking block (25) and the stripping block (27) has a bore (31), (34) to permit this penetration.

The lower end of the stripping block (27) is constructed as a hammer foot (51). The hammer foot (51) runs in a groove (49) defined in the bolt head carrier (13) (see FIG. 3.2). The groove (49) is open on the top and has an upside-down T-shaped cross-section. In the operational state, (i.e., in the position of use), the hammer foot (51) reaches below the flanks of the groove (49) and the stripping block (27) is held by its pin (28). In this operational state, a projection (35) of the striker/firing pin (19) hits a protrusion (36) (see FIG. 9) located behind it in the bore hole (34) of the stripping block (27). This engagement of the firing pin (19) and the stripping block (27) prevents the striker/firing pin (19) from falling backwards out of the bolt head (11). If the stripping block (27) is rotated by approx. an eighth of a turn (e.g., after removing the pin (28)), then the striker/firing pin (19) can be removed toward the back. Since, in this state, the hammer foot (51) still reaches under the upper flanks of the groove (49), the bolt head (11) and the bolt head carrier (13) still remain assembled, while the striker/firing pin (19) can be replaced with a new one. Only a full quarter turn of the stripping block (27) (which, of course, is only possible after removing the striker/firing pin (19)) releases the hammer foot (51) from the groove (49) and permits the bolt head (11) to be lifted from the bolt head carrier (13).

As shown in FIG. 5.1, the bore (31) in the locking block (25) (which is penetrated by the striker/firing pin (19)) is structured as an elongated hole to permit the locking block (25) to move between the positions of FIGS. 1 and 2 (locked and unlocked) despite the presence of the striker/firing pin (19).

The striker/firing pin (19) has an enlarged section (29) behind the elongated hole (31). As shown in the example of FIG. 5.1, a recess (33) which is sloped complementary to the enlargement (29) is formed in the bottom of the backside of the elongated hole (31). The recess (33) and the enlargement (29) are formed such that the striker/firing pin (19) can only penetrate the elongated hole (29) when the locking block (25) is located in its uppermost position (i.e., the locking position shown in FIG. 1). In this position, the striker (19) can be inserted so far into the elongated hole (31) that its tip can stick out of the front surface of the bolt head (11) for firing a cartridge.

If the locking block (25) is lowered, due to its special form the recess (33) presses the enlargement (29) of the firing pin (19) backward such that the tip of the firing pin (19) cannot reach a cartridge. This ensures that a cartridge can only be fired if the bolt head (11) is properly locked.

The enlargement (29) and the projection (35) cooperate to hold the firing pin (19) loosely between two positions, namely, a forward position and a rearward position. The sloped recess (33) of the locking block (25) forces a withdrawal of the firing pin (19) during unlocking. A striker spring is, thus, generally superfluous and, therefore, does not need to be provided.

A handle such as, for example, a movable front shaft, may be attached to the bolt head carrier (13). A detachable latch may secure this handle in the foremost position. In this case, a closing spring (9) is not required, but rather the handle and, thus, the bolt head carrier (13) are moved back and forth to load the weapon.

The illustrated examples are directed toward a semi-automatic loader. In these examples, the bolt head (11) is elongated toward the back by a centric extension pipe (15), which receives and guides the elongated striker/firing pin (19). The rear end of the bolt head carrier (13) extends upward to form a counter bearing (43).

An intermediate piece (39) of the bolt head carrier (13) is suspended in front of and at a distance from the counter bearing (43). The intermediate piece (39) is suspended from above. The forward position of the intermediate piece relative to the bolt head carrier (13) is limited by a step (40) (see FIG. 1), but the intermediate piece (39) can be moved towards the back.

The counter bearing (43) and the intermediate piece (39) each has a through hole. The through holes are aligned and are penetrated by the extension pipe (15). The extension pipe (15) serves as a support for a powerful pressure or opening spring (17). The spring (17) is preferably implemented as a helical, bent wire spring that surrounds the extension pipe (15). The pressure spring (17) is supported in the relaxed state in the back by the counter bearing (43) and, in the front by, the intermediate piece (39) (such that the intermediate piece (39) sits on the step (40) of the bolt head carrier (13)). This structural arrangement prevents rattling (due to the back and forth movement of the pressure spring (17)) when the breech is open.

As can be recognized, the powerful opening spring (17) is to a great extent inactive. It only becomes operative when the bolt head (11) moves backward relative to the bolt head carrier (13) in the locked position in FIG. 1. This type of movement actually occurs during firing. In particular, backward movement is forced on the barrel piece (1) and the bolt head (11) locked with it, which seems to remain in position with respect to the heavy bolt head carrier (13). This backward movement does not have to exhibit a large amplitude. The compression of a shaft cap made of rubber that is supported (e.g., against a wall) is completely sufficient.

When one looks at the drawing, this actual movement is hard to imagine. Instead, one can assume that the bolt head carrier (13) moves forward a bit during firing.

The following occurs: with this forward motion, the closing spring(s) (9) are insignificantly unburdened, but in lieu thereof the opening spring (17) is loaded. The intermediate piece (39) and the counter bearing (43) thereby move towards each other. This movement stops depending on the strength of the recoil and the strength of the impulse of the fired cartridge.

When this movement comes to a stop through the compression of the opening spring (17), then a counter movement triggered by the compressed spring (17) is introduced. In the course of this counter movement, the bolt head carrier (13) is ripped powerfully backward. As a result, the lock noses (55) of the bolt head carrier (13) pull the locking block (25) downward and then carry the bolt head (11) with it through its further backward movement. Due to this movement, the rear end of the bolt head carrier (13) cocks the hammer of a known striking mechanism (not shown), and performs a loading movement. During the subsequent advance, the locking block (25) is pressed upward again in the aforementioned manner and is, then, supported from underneath by the level, upper surface (59) of the bolt head carrier (13). It does not matter whether or not the bolt head carrier (13) is located one millimeter further forward. Thus, successive tolerances have no influence.

As already mentioned, the stronger the recoil, the longer the relative advance of the bolt head carrier (13) during firing. Correspondingly, the stronger the recoil, the more the opening spring (17) is loaded, and, the more powerfully the recoil of the entire breech (11), (13). In order to compensate for this, additional shock absorbers are attached in the form of elastomer buffers (41). To this end, two rods (45) are located parallel to the bore axis (37). These rods (45) penetrate the counter bearing (43) and are inserted into recesses in the intermediate piece (39). The rods (45) are arranged on both sides of the center of the bolt head carrier (13). These rods (45) penetrate the elastomer buffers (41). A flange (47) is located on each rod (45) between the counter bearing (43) and the buffer (41) to prevent the rod (45) from slipping backward. The recesses are open on the bottom for easy installation.

The elastomer buffers (41) are preferably comprised of several ring elements and are preferably made of a material with a high hysteresis. When a weak cartridge is fired, the elastomer buffers (41) are not or are only slightly compressed. But when a very strong cartridge is fired, then both elastomer buffers (41) are greatly compressed. The buffers (41) are structured similarly to a dead bang hammer such that they give back less energy with their renewed expansion than they previously absorbed. The increased recoil energy of strong cartridges is, thus, at least partially destroyed—or, more exactly, converted into other forms of energy. As a result, the breech is able to fire cartridges with very strongly varying recoil energy (and, thus, very widely varying muzzle energy) without having to use a different opening spring (17) and without functional problems. A separate stop between the bolt head (11) and the bolt head carrier (13) is missing. Only the opening spring (17) and the elastomer buffer(s) (41) serve as the stop.

A further advantage of the illustrated breech (11), (13) is that, in its unlocked state (see FIG. 2), the front surface of the bolt head carrier (13) extends a small distance past the front surface of the bolt head (11). Thus, a cartridge can be forced upward without its bottom getting caught, for example, on a cartridge extractor or on a projection of the front surface of the bolt head (11). The non-stressed bolt head (11) also does not try to lock during transit.

As can be seen in FIG. 6, the bolt head (11) of the illustrated example is unusual in that it has two opposite lying cartridge extractors (61). A larger version of an example cartridge extractor (61) is shown in FIG. 7. As can be seen in FIG. 7, the example cartridge extractor (61) has a hook-like formation with a hook surface (63) turned toward the rear that is designed to sit on the edge of a shot cartridge from the front. This edge is curved outward and forward so that the hook surface (63) sits on a curved formation. Depending on whether the cartridge extractor is arranged on the left or the right, the cartridge shell is ejected to the left or the right. There is no eccentric or lateral force acting on the cartridge shell during ejection, which force could occur if an individual cartridge extractor was employed. This guarantees the proper ejection of very long cartridge shells. Only near the end of the recoil path of the breech is an eccentric force exerted on the cartridge shell. This eccentric force causes release of the cartridge shell, first from one and then from the other cartridge extractor (61).

Therefore, only the ejector needs to be converted to convert from right to left ejection (or vice versa). Both cartridge extractors (61) remain where they are.

An example breech of another example repeating firearm is shown in FIGS. 10-13. The previous FIGS. 4, 5.1, 5.2, 7, 8 and 9 also apply to the example of FIGS. 10-13.

Figure 11:
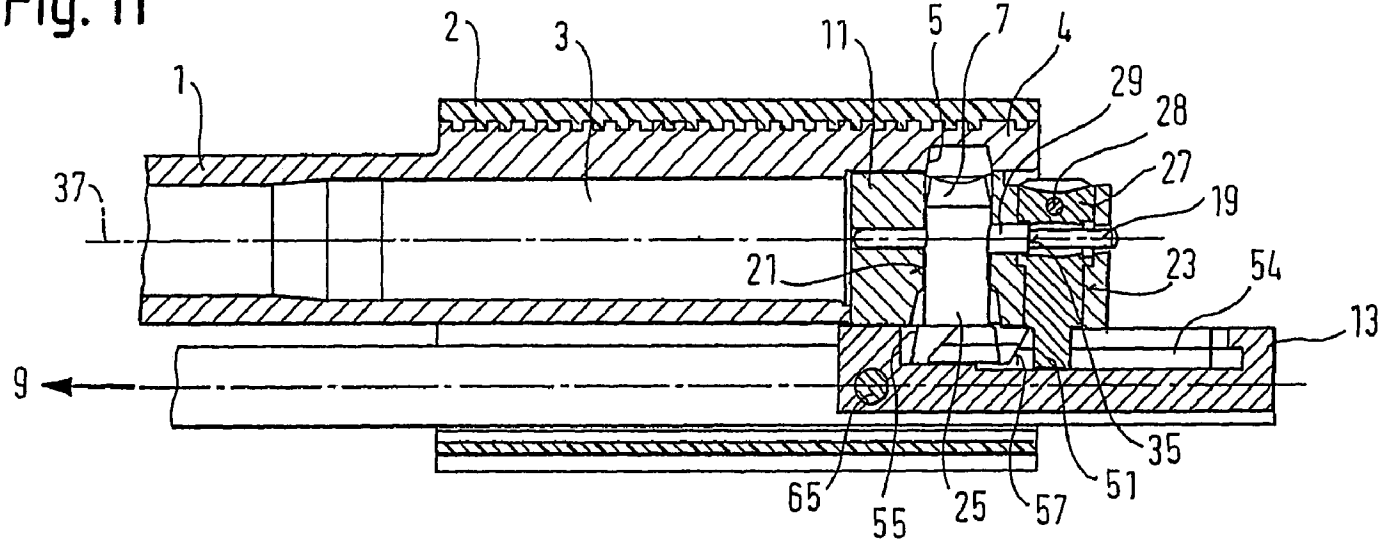
FIG. 11 is a cross-sectional view of the example weapon of FIG. 10, but showing the weapon with an unlocked breech and immediately after the firing of a shot.
Figure 10:
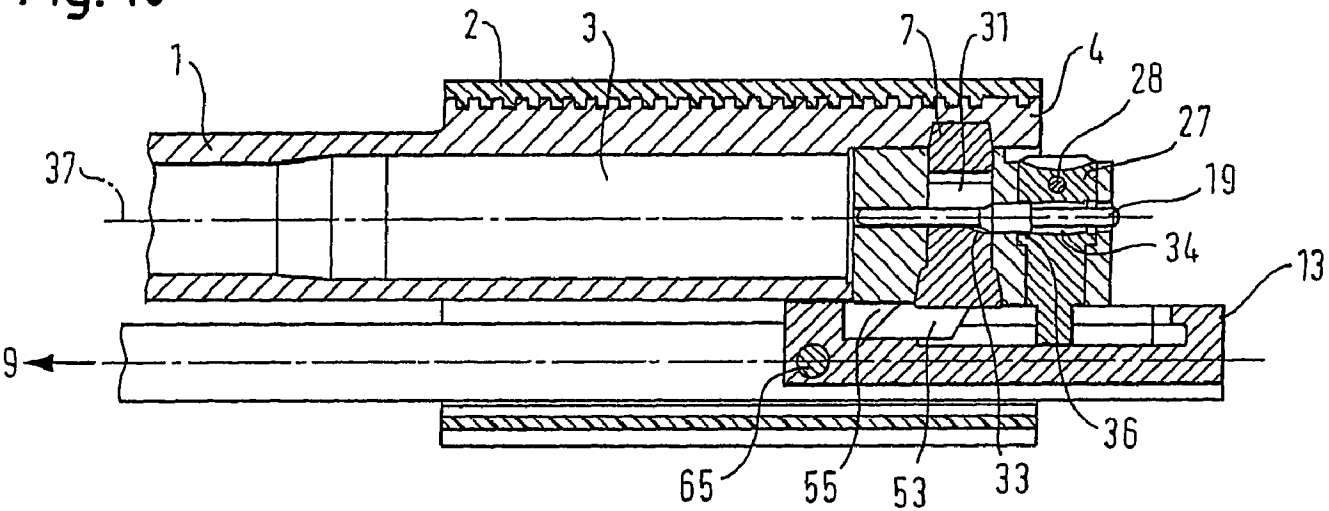
FIG. 10 is a longitudinal cross-sectional view through the rear part of the barrel piece and the breech of an example repeating shotgun shown with a closed and locked breech.

FIGS. 10 and 11 illustrate a portion of a repeating shotgun that may have a box magazine. The shot gun of FIG. 1 has a barrel piece (1) with a center or bore axis (37). A cartridge chamber (3) is located in the rear part of this barrel piece (1). An end section (4) of the barrel piece (1) defines the cartridge chamber (3).

The end section (4) has an almost U-shaped cross-section. As shown in FIG. 4, the U-shaped cross-section of the end section (4) is open on the bottom, has a concentric, upper locking recess (5), and two locking notches (6) on the bottom. The locking notches (6) are located in the free ends of the two legs of the U-shaped cross-section. A groove (10) is provided at approximately half the height of each leg of the U-shaped cross-section. Each groove (10) runs parallel to the bore axis (37). A cartridge extractor (61) such as that shown in FIG. 13, can run in each of these grooves (10).

When the weapon is cocked and ready to fire as shown in FIG. 10, the cartridge chamber 3) is locked toward the back by a bolt head (11). The bolt head (11) is penetrated by a front, vertical, transverse drill hole that receives a locking block (25). As shown and discussed above in connection with FIG. 5.1, the locking block (25) has an upside-down T-shaped cross-section which is oriented perpendicularly relative to the bore axis (37). The locking block (25) has a conical locking appendage (7) on the free (upper) end of its center shaft. As also shown in FIG. 5.1, the locking block (25) includes a locking finger (8) on each of the two ends of the (lower) transverse shaft. In the locked position, the locking appendage (7) engages with the locking recess (5) and the locking fingers (8) simultaneously engage with their corresponding locking notches (6).

In the example shown in the figures, all of the engagement surfaces are sloped with respect to a vertical line in order to facilitate effortless engagement and detachment of the locking block (25) in the end section (4) of the barrel piece (1). However, in the illustrated example, the sloped angles of the surfaces are so low that the engagement is self-locking, (i.e., the engagement cannot be released by applying a force on the bolt head (11) along the bore axis (37) towards the back of the weapon).

As a result of the engagement of the locking block (25) and the rear section (4) of the barrel piece (1), the barrel piece (1) and the bolt head (11) are directly connected with each other during a shot. Therefore, the barrel piece (1) and the bolt head (11) transfer high initial forces directly to each other. No other element is affected by this transfer of force. The back end of the barrel piece (1) can, therefore, be embedded into a plastic housing (2) because the largest occurring forces are not discharged into the housing (2).

In the illustrated example, the bolt head (11) sits on a bolt head carrier (13), which is shown in detail in FIGS. 12.1 and 12.2. The bolt head carrier (13) can be moved a certain distance longitudinally relative to the bolt head (11). The bolt head carrier (13) has a longitudinal recess (54), a transverse recess (53) in the area below the locking block (25), and level surface (59) behind this recess (53).

The transverse recess (53) is bordered on each side of the longitudinal recess (54) by a nose (55) (see FIG. 12.2). Each nose (55) flanges upward and backward as shown in FIG. 12.1. Each flange terminates at a height above the level surface (59).

The locking block (25) is constructed such that, in its upper locking position, the lower surface of its transverse shaft is flush with the lower surface of the bolt head (11) (FIG. 10). In this position, the bolt head carrier (13) can move back and forth under the locking block (25) and the bolt head (11), and the locking block (25) can glide on the level surfaces (59) of the bolt head carrier (13).

However, if the bolt head carrier (13) moves backwards from the resting position shown in FIG. 10, then both noses (55) engage the transverse shaft of the locking block (25) with their rear edges. As a result, the noses (55) pull the locking block (25) down into the transverse recess (53) into the position shown in FIG. 11. In this position, the lock block (25) disengages from the end section (4) of the barrel piece (1). As a result of this disengagement, the bolt head (11) is free to move backward relative to the barrel piece (1).

During further backward movement, the unlocked bolt head (11) runs in a guide (not shown) in the housing (2). During this rearward movement, the locking block (25) is held such that it cannot move upward.

When closing, the bolt head (11) runs all the way to the rear end of the cartridge chamber (3) or cartridge base. The bolt head carrier (13) is then pulled or pushed further forward by a closing spring (9) (shown schematically in FIGS. 10 and 11 as the direction of force (9)). In this process, one taper (57) forming the back wall of the transverse recess (53) cams the locking block (25) in the upward direction until the level surface (59) reaches under the locking block (25) and the position of FIG. 10 is reached once again.

Figure 13:
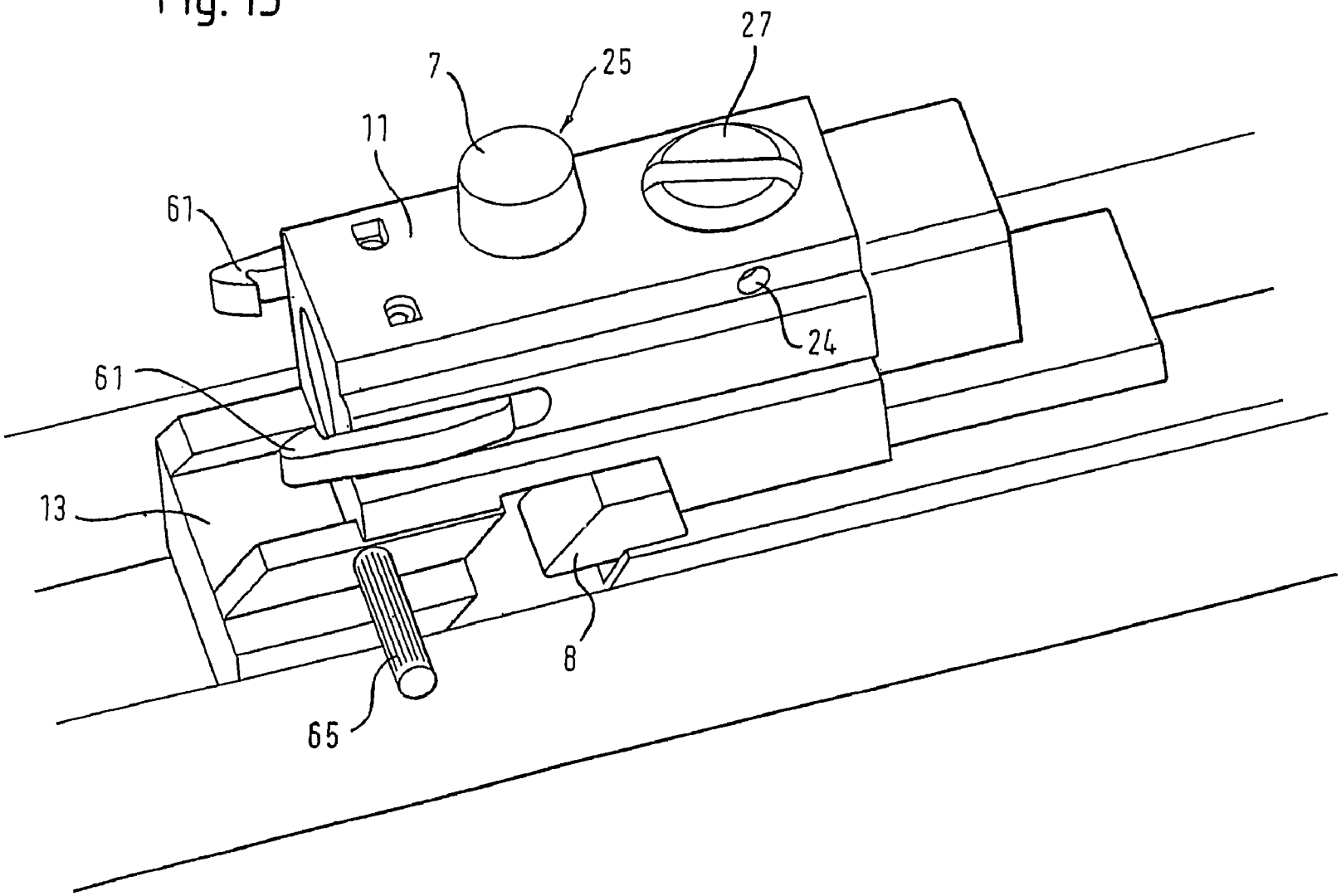
FIG. 13 is a top perspective view of the breech shown approximately in the state shown in FIG. 10.

A rotatable stripping block (27) is located in the bolt head (11) behind and approximately parallel to the middle jamb of the locking block (25). The stripping block (27) is held in its position of use by a pin (28) (see FIGS. 10, 11, 13, 8, and 9). The stripping block (27) is located in a rear, vertical transverse bore (23) in the bolt head (11). The pin (28) can be disengaged via the bore hole (24) in the bolt head (11) as shown in FIG. 13.

The locking block (25) and the stripping block (27) are penetrated by a striker or firing pin (19). Each of the locking block (25) and the stripping block (27) has a bore (31), (34) to permit this penetration.

The lower end of the stripping block (27) is constructed as a hammer foot (51). The hammer foot (51) runs in a groove (49) defined in the bolt head carrier (13) (see FIG. 12.2). The groove (49) is open on the top and has an upside-down T-shaped cross-section. In the operational state, (i.e., in the position of use), the hammer foot (51) reaches below the flanks of the groove (49) and the stripping block (27) is held by its pin (28). In this operational state, a projection (35) of the striker/firing pin (19) hits a protrusion (36) (see FIG. 9) located behind it in the bore hole (34) of the stripping block (27). This engagement of the firing pin (19) and the stripping block (27) prevents the striker/firing pin (19) from falling backwards out of the bolt head (11) when it is in the normal position. If the stripping block (27) is rotated by approx. an eighth of a turn (e.g., after removing the pin (28)), then the striker/firing pin (19) can be removed toward the back. Since, in this state, the hammer foot (51) still reaches under the upper flanks of the groove (49), the bolt head (11) and the bolt head carrier (13) still remain assembled, while the striker/firing pin (19) can be replaced with a new one. Only a full quarter turn of the stripping block (27) (which, of course, is only possible after removing the striker/firing pin (19)) releases the hammer foot (51) from the groove (49) and permits the bolt head (11) to be lifted from the bolt head carrier (13).

As shown in FIG. 5.1, the bore (31) in the locking block (25) (which is penetrated by the striker/firing pin (19)) is structured as an elongated hole to permit the locking block (25) to move between the positions of FIGS. 10 and 11 (locked and unlocked) despite the presence of the striker/firing pin (19).

The striker/firing pin (19) has an enlarged section (29) behind the elongated hole (31). As shown in the example of FIG. 5.1, a recess (33) which is sloped complementary to the enlargement (29) is formed in the bottom of the backside of the elongated hole (31). The recess (33) and the enlargement (29) are formed such that the striker/firing pin (19) can only penetrate the elongated hole (29) when the locking block (25) is located in its uppermost position (i.e., the locking position shown in FIG. 10). In this position, the striker (19) can be inserted so far into the oblong hole (31) that its tip can emerge from the front surface of the bolt head (11) for firing a cartridge.

If the locking block (25) is lowered, due to its special form the recess (33) presses the enlargement (29) of the firing pin (19) backward such that the tip of the firing pin (19) cannot reach a cartridge. This ensures that a cartridge can only be fired if the bolt head (11) is properly locked.

The enlargement (29) and the projection (35) cooperate to hold the firing pin (19) loosely between two positions, namely, a forward position and a rearward position. The sloped recess (33) of the locking block (25) forces a withdrawal of the firing pin (19) during unlocking. A striker spring is, thus, generally superfluous and, therefore, does not need to be provided.

A handle (which may be, for example, connected to a movable front shaft), may be attached to the bolt head carrier (13). A detachable latch may secure this handle in the foremost position. In this case, a closing spring (9) is not required, but rather the handle and, thus, the bolt head carrier (13) are moved back and forth to load the weapon.

When the handle (65) is pulled back, the bolt head carrier (13) is pulled along to the rear. As a result of this rearward movement, the bolt head carrier (13) pulls the locking block (25) down via the noses (55) thereby freeing the bolt head (11) for rearward travel. Therefore, the bolt head carrier (13) pulls the bolt head (11) along in its backwards movement. In the process, the rear end of the bolt head carrier (13) cocks the hammer of a known striking mechanism (not shown), and performs a loading motion. In the opposite, forward motion, the locking block (25) is pressed back up again and supported from below by the upper surface (59) of the bolt head carrier (13), as described above. This operation is not affected by minor positioning differences such as whether the bolt head carrier (13) is located one millimeter further to the front or not or by side-by-side tolerances.

One advantage of the illustrated breech (11, 13) lies in the fact that, in its unlocked state (FIG. 11), the front of the bolt head carrier (13) protrudes to the front of the bolt head (11). This configuration permits a cartridge to be transferred without getting its base caught on a cartridge extractor or on a projection of the front area of the bolt head (11). Additionally, the bolt head (11) is not subjected to stress and will not have a tendency to lock "in transit".

As can be seen in FIG. 13, unlike conventional bolt heads, the illustrated example bolt head (11) has two opposed cartridge extractors (61). An example cartridge extractor (61) is shown enlarged in FIG. 7, and is discussed in detail above.

FIGS. 14-17 illustrate another example semi-automatic shotgun. The example weapon of FIG. 14 includes a bolt head (71) which can be moved along two guide rods (73). This bolt head (71) includes a breech block (75). An extractor hook (77) is mounted on each side of the bolt head (71).

Figure 16:
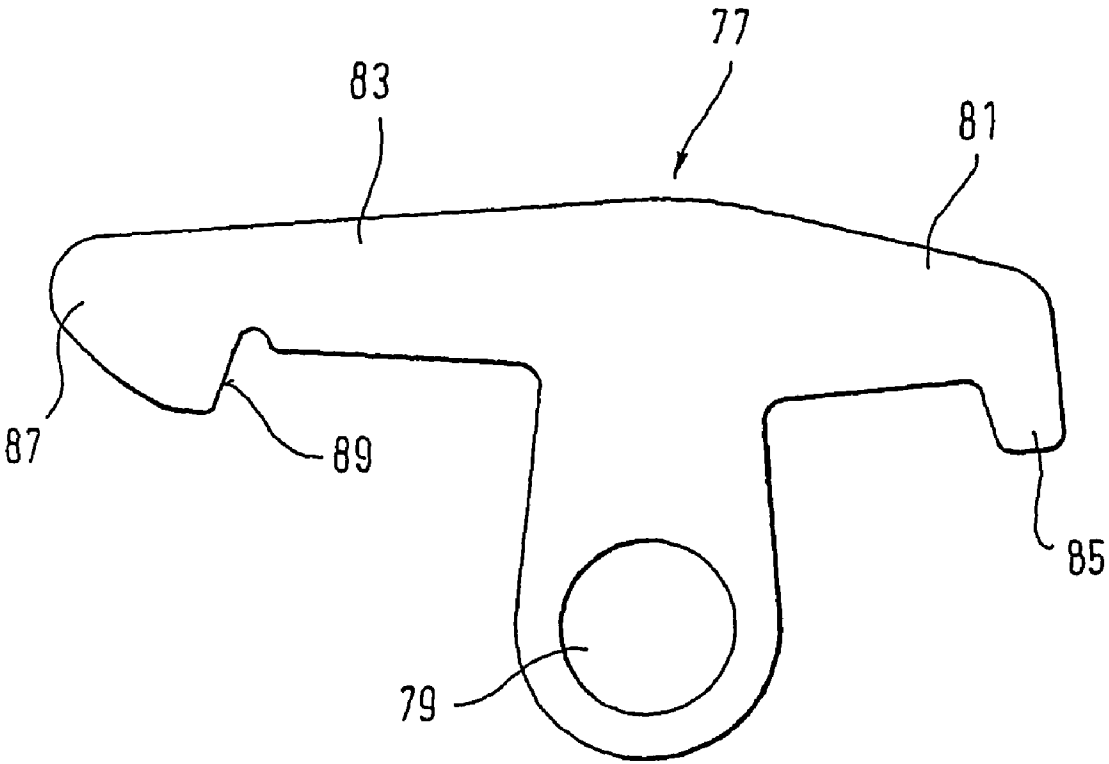
FIG. 16 is an enlarged view of an example extractor hook.

An example extractor hook (77) is shown enlarged in FIG. 16. The extractor hook (77) may be, for example, stamped out of sheet metal. The illustrated extractor hook (77) has a somewhat T-shaped profile. The end of the middle jamb of the extractor hook (77) defines a bore hole (79). A rear leg (81) of the extractor hook (77) and a front leg (83) of the extractor hook (77) extend in opposite directions from the middle jamb. Each of the rear leg (81) and the front leg (83) is positioned at a right angle to the middle jamb.

The rear leg (81) of the extractor hook (77) includes an angular connecting piece (85) on its free end. This connecting piece (85) engages in a spiral pressure spring (not shown). The front leg (83) of the extractor hook (77) includes a hook (87) on its free end. The hook (87) has a surface (89) turned toward the middle jamb. The surface (89) defines an acute angle, $\alpha$, with respect to an axis (88) that runs parallel to the middle jamb of the extractor hook (77) and transverse to the breech block (75) (FIG. 15). Each of the extractor hooks (77) can be pivoted about a substantially vertical axis. Each of these pivot axes is defined by a retaining pin (91) which passes through the bore hole (79) of the corresponding extractor hook (77) (see FIGS. 14 and 15).

Each side of the bolt head (71) includes a longitudinal cross-piece (95). A corresponding one of the extractor hooks (77) is mounted on each of these cross-pieces (95). Each longitudinal cross-piece (95) has an upper and a lower edge. The upper and lower edges extend into the breech block (75).

Figure 14:
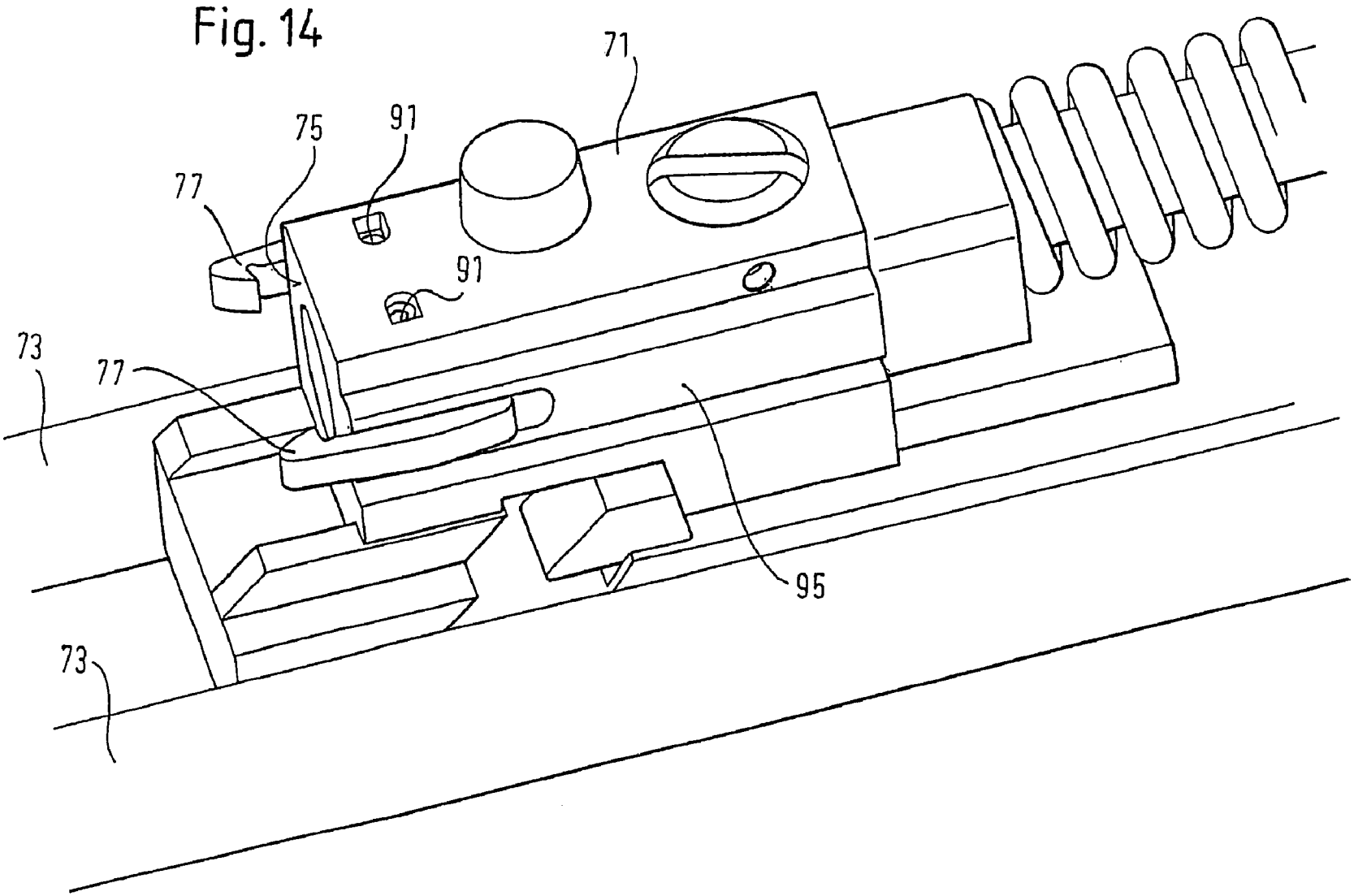
FIG. 14 is a top perspective view of an example breech of a semi-automatic shotgun.
Figure 15:
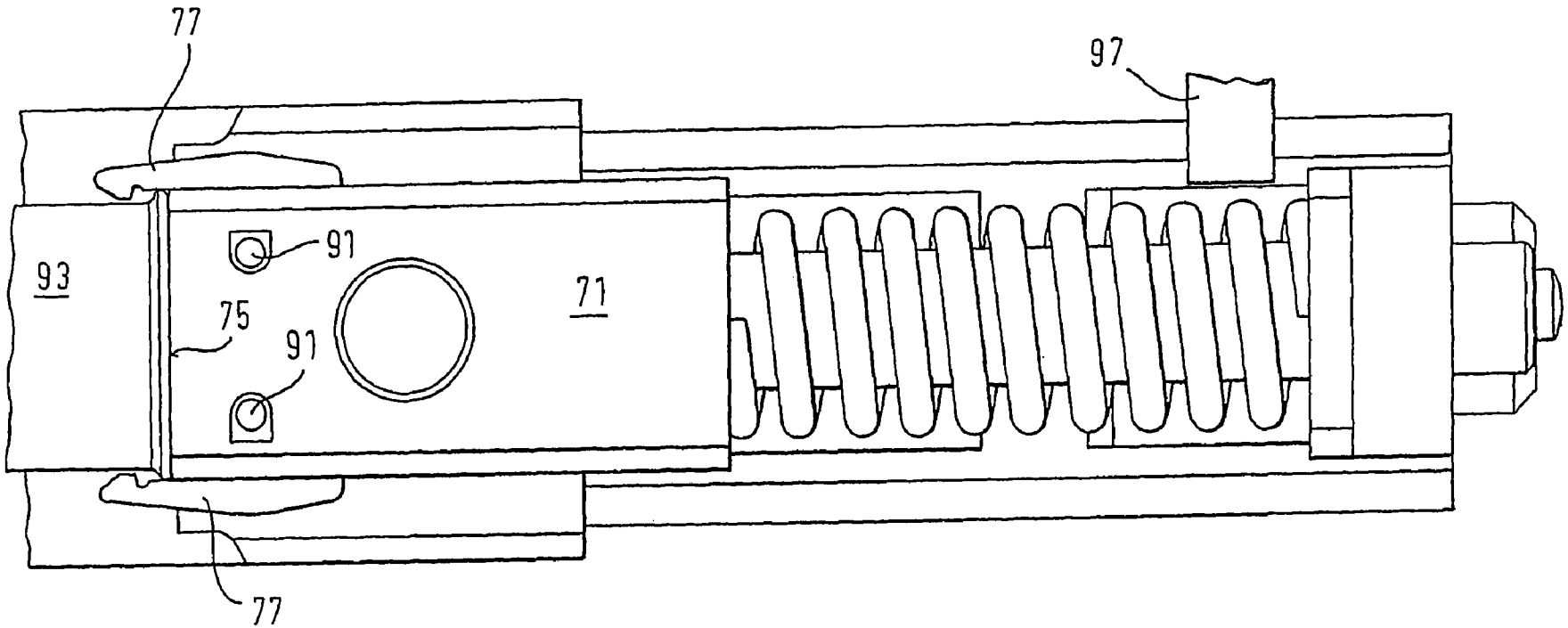
FIG. 15 is a top view of the breech with ejector of FIG. 14.
Figure 17:
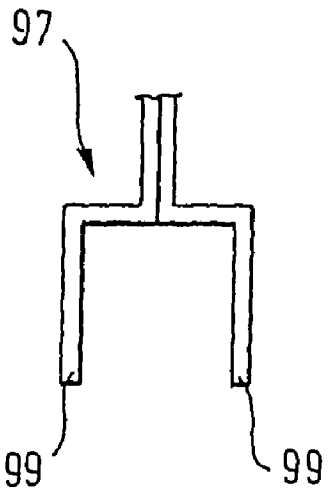
FIG. 17 is a partial view of an example ejector, seen from the front or the rear.

FIG. 15 is a top view of the breech of FIG. 14. In the example of FIG. 15, the two extractor hooks (77) are seated on opposite sides of a cartridge (93). An ejector (97) is located behind the bolt head (71). The ejector (97). When viewed from the front or from the rear as in FIG. 17, the ejector (97) has a U-shaped cross-section. When the bolt head (71) moves towards the back, a corresponding one of the longitudinal cross-pieces (95) runs through the ejector (97). The legs (99) of the ejector (97) engage the upper and lower surfaces of the corresponding longitudinal cross-piece (95) and extend onto the bolt head (71).

The cartridge or cartridge case (93) is held on the bolt head (71) by the extractor hooks (77). Thus, the cartridge or cartridge case (93) is carried along with the bolt head (71) when the bolt head (71) moves rearward. The ejector (97) remains stationary during this movement of the bolt head (71). Consequently, the longitudinal cross-piece (95) moves through the two legs (99) of the ejector (97) as the bolt head (71) moves to the rear. As the breech block (75) passes the ejector (97), the base of the cartridge (93) runs into the end of the ejector (97) and is pressed against the extractor hook (77) adjacent the ejector (97). Due to the interaction of the round profile of the cartridge border with the beveled edge (89) (FIG. 16), the extractor hook (77) is pressed back and the ejector (97) imparts a powerful thrust to the adjacent part of the cartridge border, so that the cartridge (93) tilts around the extractor (77) on the side opposite the ejector (97) and is ejected.

Switching the ejector (97) to the opposite side of the breech from that shown in FIG. 15 causes a similar ejection to the right.

The ejector (97) can be inserted into a longitudinal or transverse slot in the case of the weapon. The ejector (97) can also function to hold a component of the weapon (e.g., the ejector (97) may function as a pin).

FIGS. 18-21 illustrate an example large caliber semi-automatic rifle. The example rifle of FIGS. 18-21 uses shell cartridges that have an overall length of about 90 mm, a case length less than 30 mm, and a caliber of 20 mm. FIGS. 18-21 illustrate the same weapon. The same reference numerals are used for the same structures throughout the figures.

The illustrated rifle has a barrel (101) which is inserted into a force receiving component (104). The rear end of the barrel (101) defines a cartridge chamber (103). The cartridge chamber (103) holds the cartridge case (165) of a cartridge (163).

The force receiving component (104) forms a central anchoring element. Thus, in addition to the barrel (101), a case, a sighting electronic unit, a sling carrier and/or an attachment (e.g., a grenade launcher, an automatic pistol, etc.) can be fastened to the force receiving component (104).

The force receiving component (104) defines an upper bore hole above the bore hole that receives the barrel (101). This upper bore hole includes two portions, namely, a front bore hole (167) and a rear bore hole (171). The front bore hole (167) has a smaller diameter than the rear bore hole (171). The front bore hole (167) is constructed to receive a breech-closing spring pipe (169). The front bore hole (167) joins into the rear bore hole (171), which forms a gas cylinder. The transition between the two bore holes (167, 171) is beveled. This transition is connected to the barrel (101) by a gas intake bore hole (173). The gas intake bore hole (173) extends at a right angle to the barrel (101) and joins into the barrel (101) at the end of the cartridge chamber (103).

A pipe is placed in the two bore holes (167, 171). The pipe includes two cylindrical pipe sections with variable diameter, namely, a breech-closing spring pipe (169) and a gas piston (175). The breech-closing spring pipe (169) is adjustable, and acts as a seal in the bore hole (167). The gas piston (175) is adjustable, and acts as a seal in the gas cylinder (171). The recess between the two pipe sections (169), (175) forms the active area of the gas piston (175). The gas piston (175) is extended to the rear in a single piece, namely, as a bolt head carrier (113).

The pipe (169), the gas piston (175) and the bolt head carrier (113) together comprise a movable component. This movable component defines a breech-closing spring locating bore hole (177) to the rear. The breech-closing spring locating bore hole (177) is a blind hole which is open to the rear and closed to the front. This bore hole (177) receives a breech-closing spring (not shown), which is supported behind the illustrated arrangement in the breech.

A firing lever (not shown) is coupled to the front side of the breech-closing spring pipe (169). This firing lever is used to move the entire component (169, 175, 113) back, against the force of the breech-closing spring.

When the cartridge (163) in the cartridge chamber (103) is fired, powder gases penetrate through the gas intake bore hole (173) into the gas cylinder (171). The gases press the entire movable component (169, 175, 113) to the rear against the force of the breech-closing spring via the gas piston (175).

The bolt head carrier (113) can be moved back either by hand or automatically. The bolt head carrier (113) travels a straight-line path of motion, which runs parallel to the center line of the barrel (101). Longitudinal grooves in the case, (not shown), guide the bolt head carrier (113), together with the breech-closing spring pipe (169) and gas piston (175) in the gas cylinder (171) in the force receiving component (104).

A bolt head (111) is located behind the barrel (101) and under the bolt head carrier (113). This bolt head (111) can be moved back and forth together with the bolt head carrier (113). However, the bolt head (111) cannot be moved alone. The movement distance of the bolt head (111) is longer than the length of a cartridge (163). The movement of the bolt head (111) is guided by longitudinal grooves or cross-pieces in the case.

The bolt head (111) is penetrated by a locking bolt (125). The locking bolt (125) has the shape of a vertical letter "T." The vertical beam of the locking bolt (125) passes through a vertical bore hole (121) in the bolt head (111). This vertical beam ends below in a locking extension (107). Each of the opposite ends of the diagonally running, horizontal beam of the "T" defines a locking finger (108). In the middle, the horizontal beam has a coupling projection (183) extending to the rear.

Figure 20:
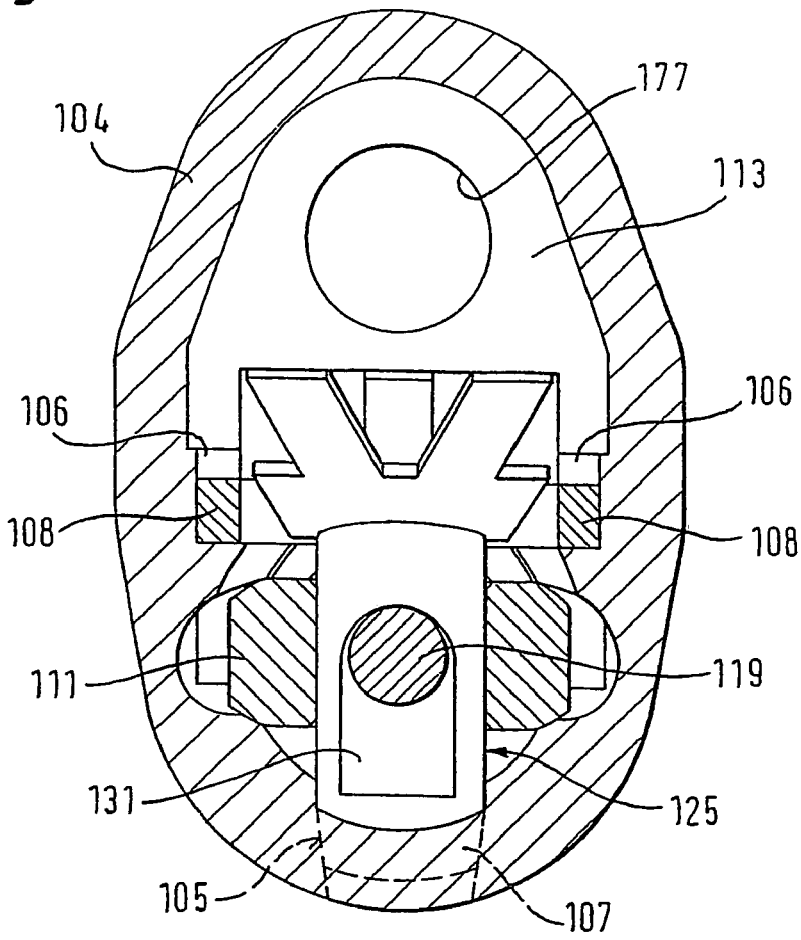
FIG. 20 is a schematic cross-sectional view through the example breech of FIG. 18.

As shown in FIG. 20, three recesses are defined in the force receiving component (104) for receiving corresponding parts of the locking bolt (125). One of the recesses is a lower, locking recess (105). The lower locking recess (105) comprises a conical bore hole. The middle of the bore hole lies on a vertical axis which passes through the center line of the barrel (101). The other two recesses are locking notches (106) symmetrically placed on opposite side of the vertical axis that passes through the locking recess (105). The locking notches (106) are seated in front of projections of the inner surface of the force receiving component (104).

Figure 18:
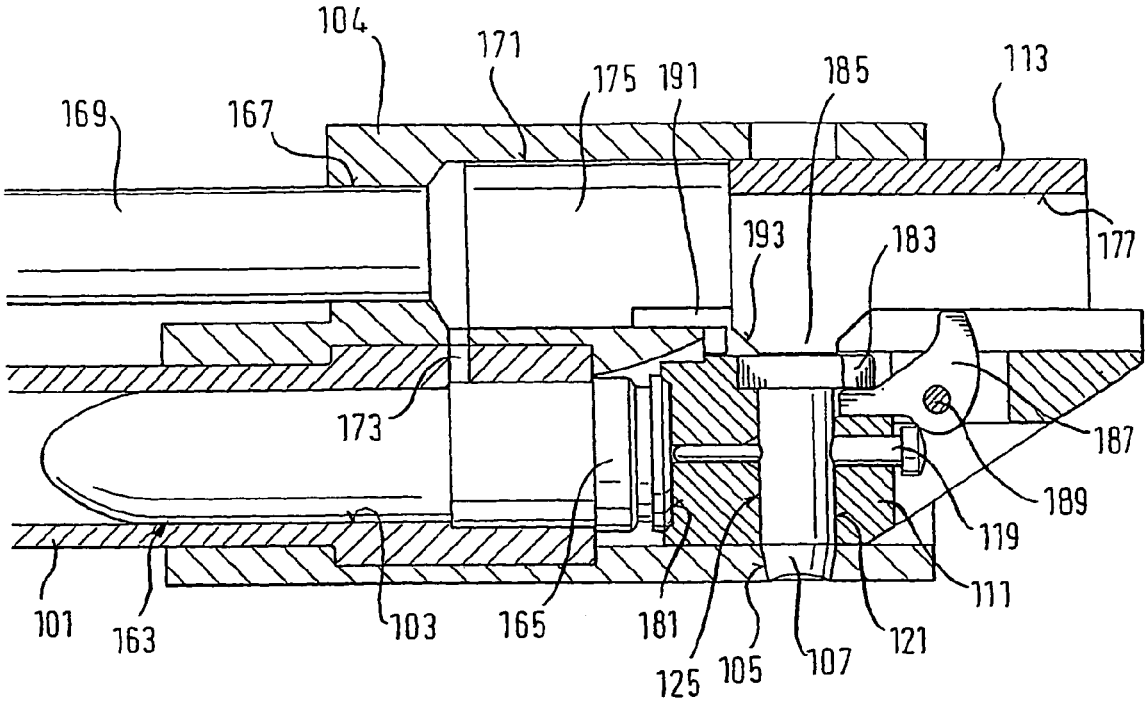
FIG. 18 is a longitudinal cross-sectional view through a rear barrel end of an example force receiving component and breech.
Figure 19:
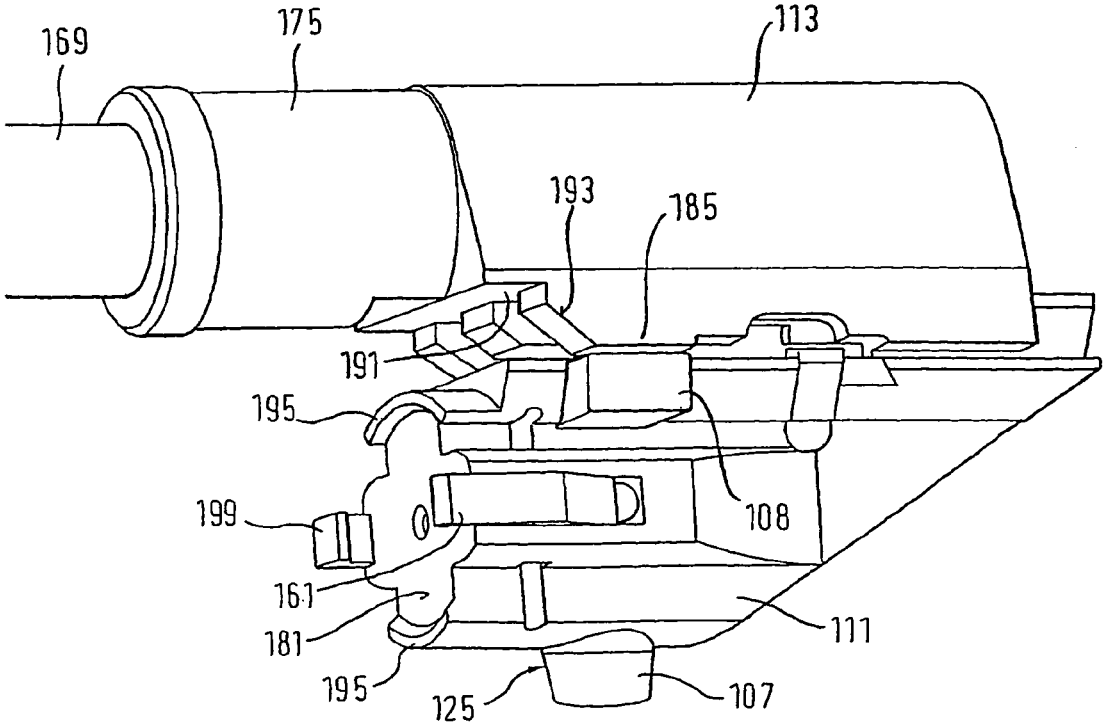
FIG. 19 is a perspective view of the example breech of FIG. 18.

When the locking bolt (125) is located in the lower position shown in FIG. 18 (i.e., the locking position), the locking extension (107) engages in the locking recess (105), and the locking fingers (108) engage in the locking notches (106). The bolt head (111) is then rigidly locked in the force receiving component (104). This is the locking position of the locking bolt (125).

When the locking bolt (125) is raised, the locking extension (107) lifts out of the locking recess (105) and the locking fingers (108) lift out of the locking notches (106). This is the unlocked position of the locking bolt (125). When the locking bolt (125) is in the unlocked position, the bolt head (111) is unlocked and can move to the rear.

A firing pin (119) passes through an oblong hole (131) in the locking bolt (125). This oblong hole (131) permits unhindered movement of the locking bolt (125) between the locked position and the unlocked position. The firing pin (119) is oriented horizontally and centrally relative to the barrel (101).

Figure 21:
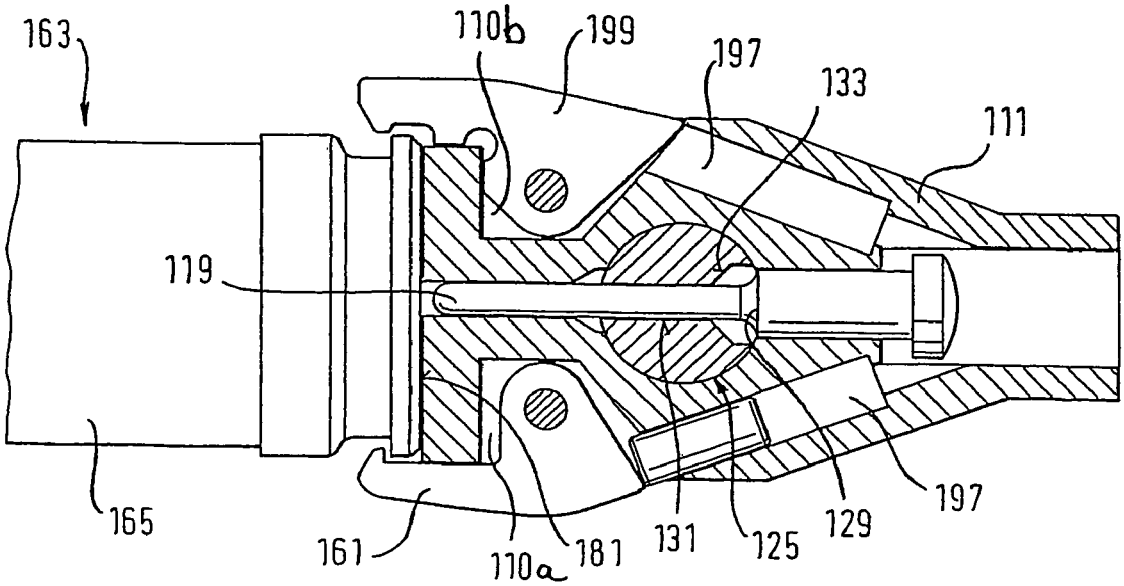
FIG. 21 is a horizontal cross-sectional view through the bolt head of FIG. 18 showing the bolt head in engagement with the rear part of a cartridge.

As can be seen in FIG. 21, the firing pin (119) has a bulge (129). The rear side of the oblong hole (131) in the locking bolt (125) has a beveled edge (133) that extends from the rear and the bottom to the top and the front. This beveled edge allows the firing pin (119) to penetrate into the locking bolt (125) from the rear when the locking bolt is in the locked position shown in the FIG. 18. However, when the locking bolt (125) moves up to its unlocked position, then the beveled edge (133) of the locking bolt (125) moves the bulge (129) of the firing pin (119) (and, thus, the firing pin (119) itself) to the rear. Consequently, the firing pin can only reach its front most position when the locking bolt (125) is in its locked position. As a result, a cartridge (163) may only be fired when the locking bolt (125) is in its locked position.

The use of the beveled edge (133) and the bulge (129) to control the position of the firing pin (119) eliminates the need for the firing pin spring required by other weapons in the prior art.

A cross shaft (189) is provided in the bolt head (111) behind the locking bolt (125). An axial tilting lever (187) is pivotably mounted on this cross shaft (189). One leg of this tilting lever (187) engages the coupling projection (183) of the locking bolt (125). The other leg of this tilting lever (187) ascends to the bottom of the bolt head carrier (113).

A descending locking projection (185) is located in front of this ascending leg of the tilting lever (187). The front side of the locking projection (185) has a beveled edge (193) that extends upward toward the top and front. This arrangement functions in the following manner. In the locked position of the breech bolt (125) (lower position), the bolt head carrier (113) is in the front most position. The locking projection (185) is seated above the locking bolt (125) and, thus, prevents the locking bolt (125) from being removed from its lowered position. The location of the tilting lever (187) in this state can be seen in FIG. 18.

Now, if the bolt head carrier (113) is moved to the rear by hand or through gas pressure, the locking projection (185) also moves to the rear, thereby freeing the locking bolt (125) for upward movement. Simultaneously, the locking projection (185) runs into the vertical leg of the tilting lever (187) and rotates it (clockwise in the drawing). As a result, the horizontal leg of the tilting lever (187) lifts the coupling projection (183) and, consequently, the locking bolt (125). The upper part of the locking bolt (125) engages in a coupling groove (191), which is constructed at the bottom side of the bolt head carrier (113) in front of the bevel (193). Simultaneously, the locking projection (185) runs over the upper leg of the tilting lever (187) and thereby keeps the tilting lever (187) tilted, so that the tilting lever (187) keeps the locking bolt (125) in the upper position, (i.e., engaged in the groove (191)). Consequently, the locking bolt (125) follows the motion of the bolt head carrier (113) to the rear. Since the locking bolt (125) remains engaged in the bolt head (111), the bolt head (111) also follows the motion of the bolt head carrier (113) to the rear. In this process, a case formation (not shown) engages the locking bolt (125) from below and prevents it from falling down.

To load and fire the next round, the bolt head carrier (113) must return to the front where the bolt head (111) contacts the rear of the barrel (101). To lock the breech, the parts (107, 108) of the locking bolt (125) must drop down into the corresponding recesses (105, 106) of the force receiving component (104). This downward movement is forced by the beveled edge (193) of the locking projection (185). In particular, this beveled edge (193) cams the locking bolt (125) downward as the bolt head carrier (113) moves forward. Simultaneously, the rear side of the locking projection (185) releases the tilting lever (187) so that it can pivot upward again into the position shown in FIG. 18. When the locking block (125) moves into the position of FIG. 18, the bolt head (111) is locked. When the locking bolt (125) is located in its bottom position (see FIG. 18), the beveled edge (133) of the locking bolt (125) releases the firing pin (119) for firing of a shot. The weapon is now ready to fire, if there is a cartridge (163) in the cartridge chamber (103). (Prior to locking, as the bolt head carrier (113) moves forward, the gas piston (175) (which, in the illustrated example, is constructed in one piece with the bolt head carrier (113)) runs into the front end of the gas cylinder (171)).

In the illustrated example, the length of the cartridge case (165) is less than one third of the total return motion of the breech (111, 113). As a result, the cartridge case (165) is completely removed from the cartridge chamber (103), even before the breech (111, 113) has been appreciably slowed by the breech-closing spring. Further, the acceleration phase of the breech (111, 113) is already completed, since the barrel (101) must be practically pressure-less by the time the cartridge case (165) is completely removed.

In order to support the cartridge case (165), the breech block (181) of the bolt head (111) is provided with support extensions (195) at the top and at the bottom. Lateral support of the cartridge case (165) is more difficult to guarantee.

Referring to FIG. 21, a horizontal cross-section through the center of the bolt head (111) is shown. The bolt head (111) has, on both sides and symmetrical to one another, two slot-shaped recesses (110*a*, 110*b*), which run to the rear through a spring bore hole (197). An extractor hook (161) is inserted in one of the recesses (110*a*). A spring (not shown) in the associated spring bore hole (197) acts on the extractor hook (161) via a tappet. The extractor hook (161) can be pivoted around a vertical axis. A supporting body (199) is seated in the other recess (110*b*). The supporting body (199) is also mounted on a vertical axis. This supporting body (199) is similar to the extractor hook (161), but it is a bit larger, so that it cannot move in the recess (110*b*). Moreover, unlike the extractor hook (161), the supporting body (199) does not encompass the cartridge base of a cartridge (163) located in the cartridge chamber (103). To reverse the ejection direction, it is merely necessary to exchange the extractor hook (161) with the spring for the supporting body (199), and to change the ejector (not shown) from one side of the weapon to the other.

From the foregoing, persons of ordinary skill in the art will appreciate that new types of semi-automatic handheld firearms have been disclosed that at least partially avoid the above disadvantages of the known recoil and gas pressure loaders. In particular, simple, inexpensive semi-automatic handheld firearms have been disclosed which can be produced with unusually high tolerances and that are particularly insensitive to usage of different ammunition.

In some disclosed examples, a powerful spring mechanism is arranged between the bolt head carrier (13) and the bolt head (11), via which the (heavy) bolt head carrier (13) is supported when the bolt head (11) is locked. Besides the spring mechanism, when the bolt head (11) is locked and a shot is fired, there is no impact between the bolt head (11) and the bolt head carrier (13), so that the initial relative movement between these parts (11), (13) is not limited by an impact.

When the bolt head (11) is locked with respect to the barrel (1), then the weapon is closed. The lock is, as usual, unlocked only if the bolt head carrier (13) has moved backwards a bit from this position. When the bolt head carrier (13) moves further backward, it takes the bolt head (11) back with it. During the subsequent forward movement of the bolt head carrier (13) and bolt head (11), a cartridge is inserted into the cartridge chamber. The bolt head (11) hits the bottom of the cartridge or the cartridge chamber and comes to a stop. The bolt head carrier (13) locks the bolt head (11) with respect to the barrel (1) and then comes to a stop.

This is the progression of movement with a common recoil loader with a rigid barrel and also the progression of movement when loading the weapon in the examples illustrated in this patent. However, while with all common semi-automatic weapons, the bolt head carrier is pressed by the closing spring against a fixed stop, (usually against the bolt head), in some of the illustrated examples, the bolt head carrier (13) is not fixed on the bolt head (11). Rather, the bolt head carrier (13) is supported on the bolt head (11) via a powerful spring mechanism, but can be moved forward without hitting a stop. The coordination of the closing spring and the spring mechanism thereby determines the final position of the bolt head carrier (13). Broad tolerances are possible and allowed here.

Incidentally, when speaking of "the closing spring" in this patent, it is understood that a closing spring and/or a closing spring mechanism may comprise one or several springs.

During a shot (from the shoulder or from the hip), some of the weapons illustrated herein perform a short, powerful backwards movement that is felt by the shooter as a recoil. All parts are then stationary with respect to the weapon as a whole, (i.e., the stationary barrel (1) and also the locked bolt head (11) follow this recoil movement).

In some of the illustrated examples, the bolt head carrier (13) does not follow the recoil movement, but rather remains in its absolute position as a result of its mass inertia, which is contrary to common practice. This means that, as a result of the recoil, the barrel (1) and the bolt head (11) move backward relative to the bolt head carrier (13), as it were, against the power of the strong spring mechanism (17); and, as the case may be, supported by the much weaker closing springs (9). As seen from the barrel (1), the barrel (1) and the bolt head (11) remain stationary. The bolt head carrier (13) moves forward relative to the barrel (1) and the bolt head (11) and is restricted by the spring mechanism.

The stronger the cartridge, the stronger the recoil, (i.e., the backward acceleration of the barrel (1) and the parts of the weapon that are rigidly connected with the barrel press the spring mechanism (17) together between the bolt head (11) and the bolt head carrier (13) in a correspondingly strong manner so that the bolt head carrier (13) moves forward all the more relative to the bolt head (11)).

In this connection, we expressly point out that the spring mechanism (17) works directly or indirectly between the bolt head carrier (13) and the bolt head (11) and, thus, can be supported by any part of the weapon that can be made stationary with respect to the bolt head (11).

The described process of the relative movement between the bolt head (11) and the bolt head carrier (13) first comes to a stop when equilibrium has been created between the spring mechanism (17), on the one hand, and the inertia of the bolt head carrier (13), on the other hand, supported as the case may be, by the power of the closing spring (9). The path of movement is, thus, rather short, since: (a) the shoulders or the arms of the shooter strive to counterbalance the recoil of the weapon, and (b) the recoil effect of the fired cartridge on the weapon (mainly) ends at the latest when the bullet or the shot has left the barrel. (With a shot gun, the proportion of the recoil is relatively low due to gases that flow out forward behind the round or bullet.)

After the relative movement stops, the compressed spring mechanism (17) begins to expand again and accelerates the bolt head carrier (13) backwards against the power of the closing spring (9) in a powerful manner. In the course of its backwards movement, the bolt head carrier (13) unlocks the bolt head (11) from the barrel (1) and carries the bolt head (11) to the rear. This completes an opening cycle of the loading movements.

As mentioned above, due to the lack of a stop, the relative forward movement of the bolt head carrier (13) beyond the locking position is relatively more pronounced when a relatively strong cartridge is fired than when a relatively weak cartridge is fired. The unlocking of the weapon, thus, requires more time with a strong cartridge than with a weak cartridge. Since a slower decrease in gas pressure is expected with a stronger cartridge than with a weaker cartridge, the delay in unlocking upon firing of a relatively strong cartridge is advantageous because there is more time available for the drop in gas pressure to occur before unlocking is achieved.

When the spring mechanism is more strongly compressed, it throws the bolt head carrier (13) backward in a more powerful manner than when the spring mechanism is only weakly compressed by a weak cartridge. Thus, with a strong cartridge, the opening of the bolt head (11) and the extraction of the cartridge shell will occur more rapidly than with a weak cartridge. With shot cartridges, this is harmless in and of itself, since stronger shot cartridges are also more modern cartridges that better withstand stress than weaker cartridges with cardboard shell jackets. But when a specific speed range of the bolt head carrier (13) is exceeded or fallen short of, the speed framework in which, on one hand, we can count on a secure locking function and, on the other hand, we cannot count on reliable extraction is abandoned. As the case may be, the durability of the weapon may even be endangered.

A particularly intense opening of the lock can be expected when the spring mechanism is completely compressed beforehand so that the intervals of the spring (17), (e.g., a flat spiral spring), sit on top of each other. Then, the opening speed can be increased in an unexpected manner. Additionally, parasitic oscillations can overlay and disrupt the system. The durability of the weapon is also a critical characteristic here.

In order to avoid such disruptions and comply with the targeted speed range to the greatest extent possible, it is further recommended that the spring mechanism oppose compression with progressively increasing power.

The lower limit of the speed range and, thus, the design of the spring (17), are selected such that reliable function can still be counted on with weak cartridges and contamination. The power of the spring mechanism does not increase linearly with stress, but rather progressively, and, in such a degree that the spring mechanism cannot be compressed significantly more, even with the firing of the strongest cartridges.

An optimized spring characteristic can, for example, be attained through a type of disk spring stack. However, it is cheaper and easier to equip the spring mechanism with a powerful spring (17) with a mainly linear power/path characteristic and, additionally, to provide a buffer arrangement (41) that is loaded after the spring (17) has been partially compressed. The spring (17) and the buffer mechanism (41) can be coordinated so that only the spring (17) is strained and expands again when firing weak cartridges, but, when firing a stronger cartridge, the buffer mechanism (41) is also stressed. The buffer mechanism (41) can guarantee the desired, progressive behavior.

A buffer mechanism made of at least one batch or stack of elastomer buffers (41) with large hysteresis has proven to be optimal. The batching or stack approach ensures that the buffer mechanism can be adjusted for strong cartridges. Furthermore, elastomer buffers (41) tend to deform transversally and, thus, increase their diameter when subjected to pressure. But, the degree of the diameter increase is a function of the length of the buffer (41) so that several stacked short buffers (41) increase less in diameter than a single, longer buffer (41).

The hysteresis of the buffers (41) is particularly important. It has the effect that not all of the power introduced into the buffers (41) is fed back to the bolt head carrier (13). Buffers (41) characterized by hysteresis ensure a decrease and phase shift of the re-directed spring power. Thus, it is possible to reliably comply with the aforementioned speed range, within which the breech can function without incident, even for the strongest cartridges.

It is, thus, possible, for example, to fire 12-caliber mixed cartridges, (e.g., different shell lengths such as 70-mm- and 76-mm-long cartridges) without incident. Through the simple adjustment of the spring (17) and the buffer device (41), cartridges of the 12/65 or 12/89 caliber can also be fired in a mixed manner, if this is not otherwise possible with a standard calibration.

In a common, prior art, semi-automatic weapon with a bolt head and a bolt head carrier, the bolt head carrier moves backwards when being unlocked, while the bolt head remains stationary. The striker/firing pin remains seated in the bolt head carrier so that the striker/firing pin does not reach the detonator cap of a cartridge until the weapon is, at least to a large extent, locked. In order to prevent this premature striking of the cartridge, some of the example weapons illustrated herein have an intermediate link. The intermediate link (39) is supported in the locked state on the bolt head (11). The spring mechanism (17) is supported on the intermediate link (39). The intermediate link (39) is transported by the bolt head carrier (13) during its recoil so that, at least shortly after unlocking, the unlocked bolt head (11) is not directly burdened by the spring mechanism (17).

Furthermore, in the illustrated examples, the striker/firing pin (19) is directly attached to the bolt head (11).

However, without further precaution, it is conceivable that a cartridge could be fired whenever the bolt head engages the cartridge, regardless of whether the breech is locked or unlocked.

In order to prevent firing when the bolt head (11) is unlocked, the illustrated examples employ a locking block (25) that is attached to the bolt head (11). When the locking block (25) is located in a locked position, the striker/firing pin (19) may strike the cartridge. But, when the locking block (25) is in an unlocked position, the locking block (25) blocks the striker/firing pin (19) in a secluded, inoperative position such that a cartridge may not be fired. In other words, the locking block (25) functions like a safety, as the trigger can only fire a cartridge when the bolt head (11) is locked.

In the illustrated examples, the locking block (25) has a taper (33) or camming surface with which it places the striker/firing pin (19) in the inoperative position during the transition time in which the bolt head (11) moves from the locked to the unlocked position. For example, if the striker/firing pin (19) gets stuck in a detonator cap as a result of a cartridge failure, then the striker/firing pin (19) is disengaged by the movement of the locking block (25) during unlocking and is placed in an inoperative position.

The locking block (25) can be moved transversely to the bore axis (37) in the bolt head (11) into and out of the locked position. Moreover, the locking block (25) passes through the bolt head (11). When in the locked position, the locking block (25) engages in a recess (5) in a component that is constructed as one piece with the barrel (1) or is otherwise rigidly affixed to the barrel (1). This engagement preferably takes place at three locations that are distributed approximately equidistantly over the perimeter of the component. Particularly with a shot gun, a generous over-dimensioning of the recess (5) and the locking block (25) is possible due to the cartridge size. The locking block (25) is preferably slightly beveled in the section that reaches into the recess (5) so that a gentle locking (above all at high housing tolerances) and unlocking is always possible.

The bolt head carrier (13) of some of the illustrated examples is structured in a longitudinally moveable manner and is located below the bolt head (11) opposite the recess (5). The locking block (25) has a front and a rear base board (8). The bolt head carrier (13) has front and rear driving rods (55, 57). During recoil, the front driving rods (55) of the backward moving bolt head carrier (13) hit the front base board (8) of the locking block (25) in order to pull it out of the recess (5). During the closing movement, the rear driving rods (57) of the bolt head carrier (13) hit the rear base board (8) of the locking block (25) in order to press/cam it into the recess (5). At least one each of the front or rear base boards (8) and the driving rods (55, 57) are beveled.

When the bolt head (11) is locked, then the bolt head carrier (13) can be moved freely forward to the position that it takes on after locking is complete. If the bolt head carrier (13) moves backward from this position, then it pulls the locking block (25) out of the recess (5) after covering a more or less large lost motion distance and then carries the bolt head (11) with it. The size of the lost motion run between the base boards (8) of the locking block (25) and the driving rods (55, 57) of the bolt head (11) is not important. It is only important that the base boards (8) fit in the opening (53) between the driving rods (55, 57) in the bolt head carrier (13). Thus, a simple and less exact production is possible. Further, inexact parts or spare parts can be installed without further adjustment.

The example weapons disclosed herein can, for example, be used for long-barreled machine pistols or for semi-automatic rifles. Some of the disclosed systems are suitable for a semi-automatic shot gun. For instance, through suitable adjustment of power, suitable construction of the spring mechanism (17), and proper selection of the dimensions of the bolt head carrier (13), a person of ordinary skill in the art can create a semi-automatic shot gun that fires varied types of munitions without incident, and that only requires a small portion of the production costs of prior art semi-automatic shot guns.

From the foregoing, persons of ordinary skill in the art will further appreciate that the disclosed automatic and semi-automatic weapons (e.g., a semi-automatic shot gun) are simple, robust and undemanding with respect to ammunition, and, thus, are universally useful. They may be used as a hunting weapon even in underdeveloped areas where one relies on varying ammunition. They may also be a valuable police or military weapon (e.g., as emergency armament in military airplanes, etc). In particular, such a weapon is particularly useful: (a) where the weapon is used after a long period of non-use, without being able to be subjected to prior examination and cleaning, (b) where one cannot be picky with respect to ammunition, and/or (c) where the costs of the weapon cannot be too high.

From the foregoing, persons of ordinary skill in the art will further appreciate that repeating firearms with a bolt head (11, 71, 111) that can be moved in the longitudinal direction of fire have been disclosed. These firearms have a locking block (25, 125) that can be moved transversely to the direction of fire. For the purpose of locking the breech, the locking block (25, 125) can be inserted in recesses in the breech. Further, the illustrated examples may include a handle (65) for moving the bolt head (11, 71, 111) forward or backward as well as for inserting and releasing the locking block (25, 125).

From the foregoing, persons of ordinary skill in the art will appreciate that repeating firearms employing a straight pull action have been disclosed. These weapons are suitable for emergency use, as well as for use in the military, by the police force, etc.

In an illustrated example, a repeating rifle is provided with a bolt head carrier (13, 113) that can be moved parallel to the bolt head (11, 71, 111) via an initial and final run. The bolt head carrier (13, 113) carries the bolt head (11, 71, 111) with it on the final run. In some disclosed examples, the bolt head carrier (13) has at least one beveled surface (55, 57), which engages in an opposite surface on a locking block (25) carried by the bolt head (11, 71) such that the locking block (25) is released from a locking position or inserted into a locking position when the initial run is made or reversed.

Using a longitudinal slide motion of a straight pull action breech in order to activate a locking block is known from the bottom lever loader system described above. This approach allows the bolt head to be kept very short, which permits the total length of the rifle to be reduced. Since the longitudinally movable bolt head carrier (13, 113) does not need to rest on the locking block (25, 125) in the longitudinal direction, the length of the path of motion of the bolt head carrier (13, 113) does not have to be precisely defined, but rather only has to be long enough to accomplished proper functioning.

It is also practical that the bolt head carrier (13, 113) be permitted to move through a lost motion run prior to the initial run. The breech remains locked during this lost motion run. This lost motion run not only compensates for structural inaccuracies, but also makes it possible for the marksman to gather momentum to facilitate manual operation of the cartridge ejection and loading mechanism. In other words, the locking block (25, 125) will not be unlocked by the bolt head carrier (13, 113) until the bolt head carrier (13, 113) has picked up speed. A breech block (11, 71, 111) is picked up along the process, perhaps without the marksman even noticing anything about the disturbance.

In preferred implementations described above, the case of the weapon is formed by the rear end of the barrel (1) or by a barrel retainer case as well as by a plastic case. Furthermore, the recesses are constructed in the case of the weapon on the rear end of the barrel (1) or in the barrel retainer case. During firing of these preferred weapons, the main recoil forces are immediately conducted from the barrel (1) into the bolt head (11, 71) via the locking block (25). The weapon housing/case, which may be made of plastic, absorbs only parasitic forces. If desired, the housing/case may be provided with flexible parts. The housing protects all the parts from fouling.

Due to the large, structural degree of freedom, the weapons disclosed herein can have practically any kind of appearance. The handle for the bolt head carrier (13, 113) can be the butt, the front shaft, a bottom lever, or simply a handle which protrudes laterally out of the (plastic) weapon housing/case, from the rear or from the front.

Further, in the disclosed firearms, the firing pin (19, 119) is mounted directly on the bolt head (11, 71, 111). More specifically, in the disclosed examples, the firing pin (19, 119) passes through the bolt head (11, 71, 111). However, without further modification, locating the firing pin (19, 119) within the bolt head (11, 71, 111) could permit the cartridge to be fired whenever the bolt head (11, 71, 111) engages the cartridge, irrespective of whether the breech is locked or unlocked.

Therefore, to prevent the firing pin (19, 119) from striking the cartridge when the breech is unlocked, the firing pin (19, 119) penetrates the locking block (25, 125) in the bolt head (11, 71, 111). When the breech is locked (i.e., the locking block (25, 125) is in a locked position), the firing pin (19, 119) may freely pass through the locking block (25, 125). However, when the locking block (25, 125), and, thus, the breech, is in an unlocked state, the firing pin (19, 119) is held in a withdrawn, inoperative position where is cannot reach the base of a cartridge in the cartridge chamber. Consequently the locking block (25, 125) acts, so to speak, as a safety, because the locking block (25, 125) ensures that the trigger can only fire a cartridge when the bolt head (11, 71, 111) is locked.

In the illustrated examples, the locking block (25, 125) has a beveled edge (33, 133) which forces the firing pin (19) back into the inoperative position when the locking block (25, 125) transitions from the locked to the unlocked position. If, for example, as a result of a cartridge defect, the firing pin (19, 119) becomes caught in the blasting cap during the shot, then it is forcibly withdrawn from the blasting cap and brought into the inoperative position by the bevel (33, 133) of the locking block (25, 125) when the locking block (25, 125) moves from the locked position to the unlocked position.

In the illustrated examples, to move in and/or out of the locked position, the locking block (25, 125) moves transversely to the axis (37) of the bore in the bolt head (11, 71, 111). Moreover, the locking block (25, 125) passes through the bolt head (11, 71, 111) and, in the locked position, engages in one or more recesses (5, 6, 105, 106) in a component (4) that is constructed in one piece with the barrel (1) or a force receiving component (104) that is rigidly fastened to the barrel (101). Preferably, the engagement between the locking block (25), 125 and the recesses (5, 6, 105, 106) occurs at three places distributed somewhat uniformly over the periphery of the locking block (25, 125). With shotguns, a generous over-dimensioning of the recesses (5, 6, 105, 106) and locking bolt (25, 125) is possible due to the size of the cartridge. The locking bolt (25, 125) is preferably slightly beveled in the sections (7, 8, 107, 108) which engage the recesses (5, 6, 105, 106), so that a gentle locking (above all, for large case tolerances) and unlocking of the locking bolt (25, 125) is always possible.

The bolt head carrier (13, 113) may be structured to be moved on the side of the bolt head (11, 71, 111) opposite the recess (5, 105). In some examples, the locking block (25) has front and rear foot strips (8) and the bolt head carrier (13) has front (55) and rear (57) carrying strips positioned so that the front carrier strips (57) of the rearward moving bolt head carrier (13) run into the front foot strips (8) of the locking block (25) in order to extract the locking block from the recesses (5, 6). During the closing motion, the rear carrier strips (57) of the bolt head carrier (13) run into the rear foot strips (8) of the locking block (25) and forces the locking block (25) into the recess (5, 6). Preferably, at least one each of the front or rear foot strips (8) and the carrier strips (55, 57) is beveled.

When the bolt head (11, 71) is locked, then the bolt head carrier (13) can be moved freely forward up to the position that it occupies after locking has been completed. If the bolt head carrier (13) moves from this position to the rear, then after a more or less large lost motion run, the bolt head carrier (13) pulls the locking block (25) out of the recesses (5, 6) and then carries the bolt head (11, 71) along to the rear. In this process, the length of the lost motion path that is formed between the foot strips (8) of the locking block (25) and the carrier strips (55, 57) of the bolt head carrier (13) is unimportant. It is only important that the foot strips (8) fit into the opening (53) formed in between the carrier strips (55, 57) in the bolt head carrier (13). Consequently, a simple and less precise manufacturing process is possible. Further, imprecise parts or replacement parts can be installed without further fitting.

The illustrated examples, can be used, for instance, for small bore repeating weapons. The illustrated examples are particularly well suited for repeating shotguns such as pump-action shotguns. Further, the illustrated systems proves to be especially well-suited for repeating rifles which fire large cartridges, in particular for rifles that fire cartridges with a caliber of more than 15 mm. The two or more extractor hooks (61, 77, 161, 199) reliably hold, convey and eject these very large cartridges.

The example repeating breech mechanisms disclosed herein may also be used for semi-automatic weapons by connecting a reloading mechanism (e.g., a gas regulator) with the handle or a pivot point provided in its place.

Persons of ordinary skill in the art will further appreciate that cartridge ejection arrangements have been disclosed which employ at least two cartridge extractor hooks (61, 77) which are spring mounted on a movable breech or bolt head (11, 71). The cartridge extractor hooks (61, 77) preferably oppose each other. These cartridge ejection arrangements are particularly well suited for the above described rifles.

In an illustrated example, a small firearm, (e.g., a semi-automatic weapon), with a barrel (1) and a breech that moves approximately from the rear end of the barrel (1) to the rear along the axis of the bore (37) (i.e., along the median axis of the barrel (1)) when opening, has a cartridge ejection arrangement. The cartridge ejection arrangement includes extractor hooks (77) and an ejector (97). The extractor hooks (77) grasp the border or near the border of the cartridge or engage in the peripheral groove of its base. The ejector (97) is seated approximately opposite one of the extractor hooks (77) in relation to the axis of the bore. The ejector (97) is positioned so that the border of the cartridge base runs into it as the bolt head (71) moves rearward. In the illustrated example, the ejector (97) is stationary. Thus, the ejector (97) may be either rigidly mounted to the weapon or its case, or it may be flexibly mounted in the breech or the bolt head (71) and, at the end of the return motion, runs into a weapons-proof resistor.

The cartridge or cartridge case is ejected transverse to the axis of the bore (37). The extractor hooks (77) are on opposite sides of the axis of the bore (37). The ejector (97) is located on the side of the axis of the bore (37) opposite to the side to which the cartridge is to be ejected.

In the case of cartridges with a border groove which is turned toward the breech block (i.e., toward the front surface of the breech), the cartridge border forms an even surface (i.e., is flush) with the front surface of the breech (75). During ejection, the extractor hooks (77) are snugly seated in the grooves with a complementary supporting surface. Therefore, the cartridge or its case cannot be released from the extractor hooks (77) until a transverse force is applied to the case. In this way, a reliable ejection of the cartridge case is ensured. In the case of a cartridge border with a round profile, (for example, in the case of small arm and shotgun cartridges), the engagement between the cartridge case and the extractor hooks (77) is only a frictional connection. A powerful spring is, thus, employed to stress the extractor hooks (77) toward the cartridge case in order to ensure the cartridge case remains captured between the hooks (77) during withdrawal and, thus, to ensure reliable ejection.

As far as can be inferred from the figures of U.S. Pat. No. 3,906,651, the '651 patent appears to illustrate a cartridge with a round profile. The cartridge is seated on the breech block of a breech that has two opposing extractor hooks. The reason why this ejection arrangement has been chosen cannot be inferred from this publication, nor is it possible to infer from this publication how the ejector should be arranged and constructed. The profile of the two extractor hooks is also unusual and facilitates sliding from the cartridge border. Such sliding must be possible in the case of one of the hooks, if it is not intended to be uncommonly softly cushioned. However, a longitudinal groove in the breech which is located close to one of the hooks and could hold the ejector may be recognized in FIG. 2 of this publication.

The ejection of some shotgun cartridges, (for example, of the 10 or 12 caliber), is often a problem, particularly in the case of very long cartridge cases and in semi-automatic weapons. Because the rapidly opening breech of a semi-automatic weapon carries the extractor hooks with it, cartridges having a round border profile may slip from the extractor hooks during this rapid opening movement.

Doubling the amount of extractor hooks as known from U.S. Pat. No. 3,906,651 could possibly remedy this problem. Further, having double the amount of extractor hooks could be advantageous in the case of extremely large cartridges which have a disproportionately small border (e.g.,flare, tear gas or shotgun cartridges of the 4 caliber (26.5 mm), 4 cm shell cartridges, or the like.).

In former times, small arms, particularly in the case of service weapons, were all constructed for right-handed marksman. Left-handers were, thus, trained to use the weapon with their right hand. Today, however, there is an attempt to do justice to the characteristics of the marksman by, for example, equipping weapons for use by left-handers. Particularly in the case of semi-automatic rifles of the Bullpup style wherein the magazine is located behind the butt, equipping the rifle for use by a left-handed marksman requires ensuring that cartridge ejection is directed away from the face of the marksman, since the ejector is typically located at the level of the cheekbone.

In the case of some weapons, (for example, with aircraft machine guns mounted in helicopters), the direction of ejection is not freely-adjustable, but must instead be adapted to the mounting conditions as best as possible. Under such circumstances, it may be desirable to cause the cartridge ejection to take place in any direction, except at the reloading mechanism. For example, if a cartridge gripper seated above the weapon is used, then the ejection can take place to the right or to the left, or even below, depending on where a cartridge case container or spent ammunition bag can be mounted.

From the foregoing, persons of ordinary skill in the art will appreciate that improved cartridge ejection arrangements have been disclosed. In particular, some of the firearms disclosed above enable the ejection direction to be changed to suit the marksman or situation presented by the intended use of the weapon.

For instance, in some disclosed examples, a stationary ejector (97) is assigned to one or both of the cartridge extractor hooks (61, 77, 161) such that, when the breech or bolt head (11, 71, 111) moves rearward, the cartridge or cartridge case is extracted from the cartridge chamber by all of the cartridge extractor hooks (61, 77, 161). Subsequently, the base of the cartridge strikes the stationary ejector (97), pivots around the cartridge extractor hook (61, 77, 161), and, in the process, is ejected to the side of the firearm opposite the ejector (97).

It is assumed that each of the extractor hooks (61, 77, 161) has only a limited capacity for keeping the cartridge (93) or cartridge case in the position in which it is pulled out. The use of several extractor hooks (61, 77, 161) is beneficial, particularly with problematic cartridges such as those mentioned above. If an ejector (97) may be assigned to any of the extractor hooks (61, 77, 161), except for those on whose side the ejection is to take place, then the ejection can take place in any desired direction.

Persons of ordinary skill in the art will appreciate that the possible number of extractor hooks (61, 77, 161) is limited by practical considerations such as weight and cost. Typically, three or more extractor hooks will only be practical for cartridges with very large diameters. In keeping with these considerations, the examples illustrated above include only two opposed cartridge extractor hooks (61, 77, 161) and one movable ejector (97). This approach is sufficient for Bullpup weapons.

If the ejector (97) includes two ejector projections arranged on opposite sides of one of the two cartridge extractor hooks (61, 77, 161) and which run in longitudinal grooves of the breech or bolt head (11, 71, 111) that are in open communication with the front face of the breech block on both sides of the cartridge extractor hook (61, 77, 161), then an ejection arrangement is created, which extracts even difficult cartridges and cartridge cases. This arrangement can be converted with the simplest of resources from right to left ejection and vice versa. In particular, to convert the ejection arrangement from right to left ejection or vice versa, only the ejector projections need be moved. The locations of the breech and the extractor hooks (61, 77, 161) remain unchanged.

Conventional cartridge extractor hooks have hooked shaped ends with surfaces turned toward the breech block to engage a cartridge border. Unlike these prior art extractor hooks, some of the extractor hooks (77) disclosed herein have ends with surfaces that form an acute angle relative to a plane parallel to the front face of the breech block (75) such that the surfaces are angled out from the breech block toward the front of the weapon. Preferably, this acute angle ranges between 0° and 15°.

In the above mentioned U.S. Pat. No. 3,906,651, the extractor hooks are designed to complement the profile of the cartridge border with which they are to be used. In contrast, in the disclosed example in which the surface of the extractor hooks (77) form acute angles relative to a plane parallel to the front face of the breech block (75), cartridges of widely varying styles may be used (e.g., a cartridge (93) whose border is parallel to the front surface of the breech block (75) or a cartridge having a border which is turned away from the front surface of the breech block (e.g., flare cartridges)) Such cartridge cases are manufactured by turning on a lathe or by indirect extrusion.

Persons of ordinary skill in the art will appreciate that the above disclosed arrangements may be used for all kinds of small arms. It is particularly advantageous to employ these arrangement with large caliber cartridges. For example, it is especially preferred to employ the illustrated arrangements with a repeating or semi-automatic shot gun. In such circumstances, the structural diversity and mutual deviation between cartridges of one and the same caliber is particularly great. On the other hand, the need for retrofitting a weapon for left-handed and right-handed marksmen is also particularly great. Such a weapon is typically not a personal weapon like an automatic rifle, which can accompany a soldier during practically his entire period of duty, but rather is often only given out for special operations.

A large caliber gas-operated rifle with a central force receiving component (104) that holds the rear end of the barrel (1) and the locking abutments of the breech is disclosed above. As used in this example "large caliber" denotes a rifle with a caliber or greatest case diameter of the cartridge of more than 15 mm. With large caliber rifles, a heavy projectile (for example, a bullet, an adapter base projectile, a charge of shot, a gas body or the like) is shot at a rather low speed compared with other, small caliber high-performance rifles. Consequently, the gas pressure is also comparatively low, particularly in the front region of the barrel.

In the case of a large caliber, gas-operated rifle whose cartridge diameter is above 15 mm, the breech is large and long, and hence heavy. As a result, the force required to reload it is also large. Since, as already mentioned, the gas pressure of such a rifle is low, the action area of the gas piston must be great. Accordingly the quantity of gas which is depleted from the barrel during firing is also large. For this reason, recoil-operated guns have usually been preferred. However, recoil-operated guns have the disadvantage of being particularly sensitive to the type of ammunition used.

In case of large caliber weapons, a central anchoring element upon which all occurring forces are supposed to impinge has recently been provided to save weight. To a large extent, when such a central anchoring element is employed, the weapon case can be designed in the lightest plastic style, since the weapon case is subjected to little stress because the stresses are largely absorbed by the central anchoring element. A gas piston which usually interacts with the gas cylinder, requires an additional point of power input at the tapping point of the barrel. Consequently, it is rather heavy in construction.

Large caliber rifles are disadvantaged in that the rifle is built rather long, when it is constructed as an enlarged, normal caliber rifle.

From the foregoing, persons of ordinary skill in the art will appreciate that semi-automatic rifles for large caliber shell cartridges with a long cartridge length and short cartridge case have been disclosed. The disclosed rifles are light and reload reliably.

A disclosed example rifle includes a gas intake opening (173) defined in the force receiving component (104) and in the barrel (101). A gas cylinder (171) is firmly joined with the force receiving component (104). The gas intake opening is in communication with the barrel (1) and the gas cylinder (171). Having the gas intake opening (173) in the force receiving component (104) makes a separate, power absorbing enclosure for the gas intake opening unnecessary. Furthermore, the gas intake opening (173) is placed far to the rear, where the gas pressure is sufficient for unlocking and operating even a heavy breech with a long reloading path.

In the illustrated example, the barrel (101) of the weapon is preferably provided, as is generally the practice, with a cartridge chamber (103) that is constructed in one piece with the barrel (101). However, it is also conceivable that the cartridge chamber (103) be separate from the barrel (101). As used herein, the term "barrel" includes the cartridge chamber (103), whether it is constructed in one piece with the barrel (101) or separate from the barrel (101).

In the illustrated example, the gas intake opening (173) is located near the front end of the cartridge chamber (103). The gas intake opening (173) is in communication with a bore hole in the force receiving component (104), which is, in turn, in communication with the front end of the gas cylinder (171). In the case of extremely large caliber rifles, the cartridge chamber (103) is often rather short compared with the caliber of the barrel (101). In the case of shell cartridges like those described above, the cartridge chamber (103) is extremely short. Thus, slow acceleration of the breech by the discharge gases is sufficient to ensure that the projectile has left the barrel prior to the opening of the breech. With large caliber rifles, the pressure decrease usually occurs so prematurely that the excess pressure in the barrel (101) is rather low when the projectile leaves the barrel (101). The illustrated example does not use a conventional pipe or similar component. The force receiving component (104) ensures that even a high pressure in its bore is harmlessly received and passed on to the gas cylinder (171). This gas cylinder (171) is preferably constructed in the force receiving component (104) and, consequently, does not require its own power absorbing component.

The bore (173) can extend diagonally either in the direction of fire or opposite the direction of fire in order to utilize or inhibit the kinetic energy of the discharge gases. Since the kinetic energy at the end of the chamber (103) is quite low, it is preferred that the bore hole (173) extends at a right angle to the direction of fire. This permits the force receiving component (104) to be kept as compact as possible.

The gas cylinder (171), which directly connects to the bore (173), can be seated laterally or underneath the cartridge chamber (103). However, in order to avoid excessively extending the width of the weapon and to be able to mount a magazine under the breech, it is preferred that the gas cylinder (171) be seated above the cartridge chamber (103). Constructing the gas cylinder (171) in the force receiving component (104) above the cartridge chamber enables a weapon style that is very stout, and that has a short length in the longitudinal direction.

The breech of the illustrated example is, as usual, formed from a bolt head (111) and a bolt head carrier (113). To make a regulator for the bolt head carrier (113) unnecessary, and to keep the style of the weapon short in spite of the gas cylinder (171) being located far in the rear, the bolt head carrier (113) of the illustrated example forms the gas piston.

Similar to a semi-automatic shotgun with a pipe magazine, where the gas piston surrounds the magazine pipe, in the illustrated example, it is preferred that a pipe (175) be firmly joined to the bolt head carrier (113); that the pipe (175) passes through the gas cylinder (171); and that the pipe (175) emerges to the front of the force receiving component (104) as an attachment pipe (169) for a breech-closing spring. The inner surface of the gas cylinder (175) has an annular-shape. Moreover, the gas discharge force occurs precisely centrally on the bolt head carrier (113). The pull-back spring for the breech, (i.e., the so-called "breech-closing spring"), passes through the pipe (169), so that the bolt head carrier (113) forming the gas piston (175) can also be reset precisely centrally and, consequently, cannot jam. As a result, the diameter of the gas cylinder (171) can be built shorter than would otherwise be possible.

In some examples, the pipe (169, 175) carries a loading handle, which is either mounted to the pipe (169, 175) or can be attached or joined to it. This handle is used for reloading.

Persons of ordinary skill in the art will recognize that there are various conventional means of locking a breech. For example, lateral locking shutters or locking lugs mounted in a circle around the longitudinal center of the barrel are known. However, the shutters are applied off center, while lugs involve a backward motion of the bolt head, which increases the overall length of the rifle, even if only slightly. Therefore, in an illustrated example, a locking bolt (125) penetrates transversely through the bolt head (111) and is pressed into a safety position by the bolt head carrier (113) when the bolt head carrier (113) is in its resting position. When the locking bolt (125) is in the safety position, it engages in recesses (105, 106) of the force receiving component (104) and, as a result, is locks the bolt head (111). The recesses (105, 106) are advantageously disposed somewhat circular-symmetrically to the longitudinal axis of the barrel. To unlock the bolt head (111), the blot head (111) does not have to travel an unlocking distance, but instead the locking block (25) is simply pulled out at a right angle to the longitudinal axis of the barrel (101). The device that move the locking block (125) can be located above the bolt head (111) and, thus, does not take up any overall length.

Preferably, a tilting lever (187) is provided to assist in the unlocking. The tilting lever (187) is arranged in the bolt head (111). One end of the tilting lever (187) engages in the path of motion of the bolt head carrier (113). The opposite end of the tilting lever (187) engages in the path of motion of the locking bolt (125). When the bolt head carrier (113) moves back, it rotates the tilting lever (187) to thereby pull the locking bolt (125) out of the recesses (105, 106) of the force receiving component (104). The tilting lever (187) is pivoted, for example, on a swiveling axis (189) which is transversely arranged in the bolt head (111). However, the tilting lever (187) may alternatively be replaced by a pressure spring which forces the locking bolt (125) out of the recesses (105, 106) when the bolt head carrier (113) has moved back sufficiently to permit the upper part of the locking bolt (125) to enter the coupling groove (191).

Additionally it is preferred that the locking bolt (125) engages in the bolt head carrier (113) when the locking bolt (125) is in the unlocked position so that the locking bolt (185) and the bolt head (111) move with the bolt head carrier (113). In the illustrated example, a positive connection is created between the bolt head (111) and the bolt head carrier (113) via the locking bolt (125), regardless of how quickly the bolt head carrier (113) moves rearward. Thus, for example, the positive connection is formed even in the case of slow reloading.

Preferably the locking bolt (125) defines an oblong hole (131) through which the firing pin (119) passes. The firing pin (119) has a bulge (129) behind the locking bolt (125). The oblong hole (131) has a beveled edge (133) to the rear, which engages on the bulge (129) of the firing pin (119) and pushes it back when the locking bolt (125) is pulled out of engagement with the recesses (105, 106) of the force receiving component (104), i.e. when it is unlocked. Thus, after a shot, the firing pin (119) is forcefully pushed out of engagement with the cartridge (103) and cannot reach the cartridge base as long as the breech is unlocked. Consequently, a burst blasting cap (i.e., a so-called primer failure) cannot keep the firing pin (119) to the front, and a premature firing cannot take place when the bolt head (111) is not yet locked. This guarantees reliability and safety, even in the case of rare malfunctions.

Normally a bolt head (111) has only one extractor. However, as discussed above, providing two extractors is also known. As discussed in detail above, the illustrated bolt head (111) employs one extractor element (161) and one supporting element (199). In this example, there are two recesses (110*a*, 110*b*) in the bolt head (111) on opposite sides of the locking bolt (125). The rear of one of the recesses (110*b*) is in communication with a bore hole. The rear of the other one of the recesses (110*a*) is in communication with a bore hole for a set-bolt and a spring (197). An extractor (161) is located in one of the recesses (110*a*). The extractor (161) can be swiveled against the force of the spring as transferred by the set-bolt. A supporting element (199) is inserted in the opposite recess (110*b*). The supporting element (199) is located opposite the extractor (161), and laterally supports the base of a cartridge (163) or cartridge case (165). The extractor (161) and the supporting element (199) face one another.

The supporting element (199) supports the cartridge case (165) after the extraction, so that the cartridge case (165) does not slip from the opposing extractor hook (161). After the shot, the breech first undergoes an acceleration phase and then a deceleration phase. During the deceleration phase, the base of the accelerated cartridge case rests firmly on the breech block (181). The front area of the bolt head (111) is called the "breech block."

The spring, set-bolt and extractor (161) on one side and the supporting element (199) on the opposite side can, if desired, be exchanged to change the direction of cartridge ejection.

However, in the case of the shell cartridges discussed above, the cartridge case is very short. As a result, the shell case could possibly leave the cartridge chamber during the acceleration phase or shortly after the acceleration phase. Since the supporting element (199) and the extractor (161) are seated in recesses (110*a*, 110*b*) of the same type, they can be interchanged. In this manner, it is possible to rearrange the ejection direction of the rifle so that the rifle can be easily adapted to right-handed shooters or left-handed shooters.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A gas-operated rifle comprising:

a barrel;

a bolt head;

a firing pin having a bulge;

a bolt head carrier having a forward position and a rearward position;

a central force receiving component receiving a rear end of the barrel and defining a plurality of recesses; and a locking bolt penetrating the bolt head, the locking bolt being movable between: (1) a locked position wherein the locking bolt engages in the recesses of the central force receiving component to thereby lock the bolt head to the central force receiving component and (2) an unlocked position wherein the bolt head is free to move with the bolt head carrier, the locking bolt being pressed by the bolt head carrier into the locked position when the bolt head carrier is in the forward position, the locking bolt defining an oblong hole which is penetrated by the firing pin, the oblong hole having a beveled edge which engages the bulge of the firing pin to push the firing pin rearward when the locking bolt moves from the locked position to the unlocked position;

wherein the barrel defines a gas intake opening, a gas cylinder is located in the central force receiving component, the gas cylinder is in communication with the gas intake opening, and the bolt head carrier forms at least a portion of a gas piston which cooperates with the gas cylinder.

2. A rifle as defined in claim 1, wherein the barrel is in communication with a cartridge chamber, the gas intake opening is in communication with an upper end of the cartridge chamber and a front end of the gas cylinder.

3. A rifle as defined in claim 1, wherein the gas cylinder is integrally formed in the central force receiving component.

4. A rifle as defined in claim 1, wherein the gas intake opening extends at a right angle to a direction of fire.

5. A rifle as defined in claim 1, wherein the gas cylinder is located above the cartridge chamber.

6. A rifle as defined in claim 1, further comprising a pipe coupled to or integral with the bolt head carrier, the pipe at least partially penetrating the gas cylinder, and the pipe receiving a breech-closing spring.

7. A rifle as defined in claim 6, further comprising a loading handle coupled to the pipe.

8. A rifle as defined in claim 1, further comprising a tilting lever in the bolt head, the tilting lever having a first end located in a motion path of the bolt head carrier and a second end located in a motion path of the locking bolt, wherein a movement of the bolt head carrier from the forward position to the rearward position pivots the first end of the tilting lever out of the path of the bolt head carrier such that the second end of the tilting lever forces the locking bolt from the locked position to the unlocked position.

9. A rifle as defined in claim 8, wherein the locking bolt engages in the bolt head carrier when the locking bolt is in the unlocked position such that movement of the bolt head carrier also moves the locking bolt and the bolt head relative to the central force receiving component.

10. A rifle as defined in claim 1, wherein the bolt head defines a first recess and a second recess located on opposite sides of the locking bolt, each of the first and second recesses being in communication with a respective bore hole.

11. A rifle as defined in claim 10, further comprising:

an extractor pivotably mounted in the first recess;

a spring mounted in the bore hole communicating with the first recess to apply a biasing force to the extractor; and a supporting element mounted in the second recess opposite the extractor;

wherein the extractor and the supporting element cooperate to support a base of a cartridge or cartridge case, and the extractor can be swiveled against the biasing force of the spring.

* * * * *